US007818894B2

(12) United States Patent
Noyes et al.

(10) Patent No.: US 7,818,894 B2
(45) Date of Patent: Oct. 26, 2010

(54) METHOD AND APPARATUS FOR LOW-ENERGY IN-BIN CROSS-FLOW GRAIN AND SEED AIR DRYING AND STORAGE

(76) Inventors: Ronald T. Noyes, 1116 Westwood Dr., Stillwater, OK (US) 74074-1116; Vitaly G. Danchenko, Elevator Ltd. Company, 6, office .306, Teatralna Street, Dnepropetrovsk (UA) 49008

( * ) Notice: Subject to any disclaimer, the term of this patent is extended or adjusted under 35 U.S.C. 154(b) by 136 days.

(21) Appl. No.: 12/252,159

(22) Filed: Oct. 15, 2008

(65) Prior Publication Data

US 2009/0094853 A1 Apr. 16, 2009

Related U.S. Application Data

(60) Provisional application No. 60/980,137, filed on Oct. 15, 2007.

(51) Int. Cl.
*F26B 3/06* (2006.01)
*F26B 25/06* (2006.01)
*F26B 23/02* (2006.01)
*F26B 9/06* (2006.01)

(52) U.S. Cl. ..... 34/169; 34/174; 34/175; 34/219; 34/223; 34/225; 34/230; 34/233

(58) Field of Classification Search ..... 34/165, 34/168, 169, 174, 175, 218, 219, 223, 224, 34/225, 230, 232, 233
See application file for complete search history.

(56) References Cited

U.S. PATENT DOCUMENTS 3,090,133 A 5/1963 Kline et al.
3,470,626 A 10/1969 Pfeiffer
3,526,969 A 9/1970 Alms
3,557,979 A 1/1971 Zortman
3,736,667 A 6/1973 Mcclaren
4,009,520 A 3/1977 Sukup (Continued)

OTHER PUBLICATIONS

Robert Hansen, Eli Troyer, and Harold Keener, "Success With Natural-Air Grain Drying," Resource, Jan./Feb. 2008 (available at http://digitaledition.qwinc.com/publication/?i=11536).

(Continued)

*Primary Examiner*—Jiping Lu
(74) *Attorney, Agent, or Firm*—Martin S. High, P.C.

(57) ABSTRACT

This process embodies forcing air through grain and granular biological products using a high volume horizontal airflow from a central vertical pervious tube to one or more plenum chambers near the structure sidewall to dry or cool products. Cross-flow air movement can be supplied by either suction or pressure. This conditioning and drying method has advantages over conventional storage structures, especially where product depth is much greater than diameter. In this process, horizontal air typically moves only ⅓ to ⅙ of vertical distances. Horizontal airflow resistance through elongated seeds is 50-60 percent of vertical airflow. Power for horizontal airflow is typically 8-15% that of vertical airflow. Grain and seed drying costs will be 15-30% of high temperature drying. To enhance germination, storage and grain and seed quality, and to kill or exclude insect pests, ozone is applied to drying or aeration airstreams for treating stored products and storages.

19 Claims, 8 Drawing Sheets

U.S. PATENT DOCUMENTS

| | | | | |
|---|---|---|---|---|
| 4,067,120 | A | 1/1978 | Bradford | |
| 4,142,302 | A | 3/1979 | Primus | |
| 4,159,580 | A | 7/1979 | Welch | |
| 4,217,701 | A | 8/1980 | Mathews | |
| 4,308,669 | A * | 1/1982 | Noyes et al. | 34/504 |
| 4,337,584 | A * | 7/1982 | Johnson | 34/65 |
| 4,587,893 | A | 5/1986 | Brockhaus et al. | |
| 4,599,809 | A | 7/1986 | Parkes | |
| 5,233,766 | A * | 8/1993 | Frederiksen et al. | 34/171 |
| 2003/0079365 | A1 | 5/2003 | Corak et al. | |
| 2004/0022121 | A1 | 2/2004 | Yamamoto et al. | |
| 2007/0234587 | A1 | 10/2007 | Pierson et al. | |

OTHER PUBLICATIONS

Dietz, John, "Better grain storage can cut costs and spoilage," Western Producer, Aug. 3, 1995.

ASAE Standards 1993. (1993). "Table 1. Equilibrium moisture content of grains and seeds (percent wet basis)," ASAE D245, DEC92, Moisture Relationships of Grain, American Society of Agricultural and Biological Engineers, St. Joseph, MI, USA, 413-414.

Day, D.L. and Nelson, G.L. (1962). "Predicting performances of cross-flow systems for drying grain in storage in deep cylindrical bins." ASAE Paper No. 62-925, American Society of Agricultural Engineers, St. Joseph, MI, USA, December.

Day, D.L. and Nelson, G.L. (1964). "Drying effects of cross-flow air circulation on wheat stored in deep cylindrical bins." Technical Bulletin No. T-106, Oklahoma Agricultural Experiment Station, Oklahoma State University, Stillwater, OK, January.

Jayas, D.S. and Mann, D. (1994). "Presentation of airflow resistance data of seed bulks, Applied Engineering in Agriculture," American Society of Agricultural Engineers, St. Joseph, MI, USA, 10(1), 79-83.

Jayas, D.S. and Muir, W.E. (1991). "Airflow-pressure drop data for modeling fluid flow in anisotropic bulks," Transactions of ASAE, American Society of Agricultural Engineers, 34(1), 251-254.

Navarro, S., Noyes, R. and Armitage, D. (2002). "Supplemental aeration systems, Chapter 8, The Mechanics and Physics of Modern Grain Aeration Management," Navarro and Noyes, Editors, CRC Press, Boca Raton, FL, 417-424.

* cited by examiner

METHOD AND APPARATUS FOR LOW-ENERGY IN-BIN CROSS-FLOW GRAIN AND SEED AIR DRYING AND STORAGE

CROSS-REFERENCE TO RELATED APPLICATIONS

This application claims the benefit of the filing date of U.S. Provisional Patent Application No. 60/980,137, filed on Oct. 15, 2007, titled "Method and Apparatus for Low-Energy In-Bin Cross-Flow Grain and Seed Air Drying And Storage," which is incorporated by reference in its entirety for all purposes as if fully set forth herein.

STATEMENT REGARDING FEDERALLY SPONSORED RESEARCH OR DEVELOPMENT

Not applicable

FIELD OF THE EMBODIMENTS

The field of the embodiments is generally related to grain storage.

BACKGROUND OF THE EMBODIMENTS

Airflow in conventional bolted steel bins and concrete silos is limited to relatively low airflow rates by vertical depth, seed characteristics, and high static pressure. Conventional vertical pressure aeration also adds "heat of compression," typically 3° C. to 8° C. temperature rise to ambient air.

Most conventional bolted, corrugated steel bins are typically sold with the "standard" vertical pressure aeration with an airflow rate of 0.1 (1/10) cfm/bu. Approximately 150 hours of aeration fan time is required at 1/10 cfm/bu to completely cool stored grain with level top biological product surface. Peaked grain increases cooling time by 25-35%.

Stored grain insect populations grow exponentially. Warm to hot surface grain is ideal for insect population growth. If a bin of fresh grain has 100 fertile female adult stored product insects on July 1, by mid-September the insect population can increase to 1-3 million adult insects.

Although suction aeration cooling is a major non-chemical insect management tool, U.S. steel grain bin manufacturers will not warrantee a steel bin with a suction aeration system due to roof collapse damage potential.

Freshly harvested moist grain must have fresh air moving through it within 12-24 hours to prevent biological heating triggered by mold spore germination, leading to mold, spoilage and possible formation of toxins, which degrades market value, or makes grain unusable for livestock or poultry feed.

Much U.S. grain is dried on farms and commercial grain elevators in independent high temperature grain dryers, using high volumes of fossil fuels. Bin drying is slow, even with batch grain depths of only 4 to 5 feet, due to slow loading and unloading, and limited heat and airflow. In-bin grain drying systems burn high volumes of fossil fuel to heat drying air. In-bin deep bed drying is characterized by over-dried bottom grain and under-dried grain near the top biological product surface, such as 10% moisture bottom grain and 18% moisture surface grain for grain dried to 14-15% final moisture. Although the grain is blended some during unloading, if the top grain is not mixed well during unloading, pockets of spoilage may develop.

High temperature cross-flow grain drying—at 60-110° C. (140-230° F.)—causes multiple stress cracks of the pericarp (seed coat) of corn (maize) and damages the starchy endosperm, gluten and germ of corn and other grain. When seed or kernel temperatures exceed 40-41° C. (104.0-105.8° F), seed germination damage begins. Conventional vertical airflow for in-bin drying and aeration is limited by the high static air pressures required to move drying or cooling airflow rates through deep grain.

Much higher volumes of ambient or heated air can be forced through full bins of moist grain using cross-flow air movement technology with very low electrical power and low static pressures. Thus, in-bin cross-flow drying can provide an economical, ecological and environmentally viable method of curing moist grain, even in extremely large grain drying volumes.

Natural air and low temperature heated-air drying (air temperatures below 40° C. (104° F.) preserves grain germination at the highest quality levels. In a cross-flow bin dryer, high airflow through a deep bed of grain at 30-40° C. and 65% RH will dry 25-30% grain to about 12-13% near the vertical aerator and about 13-14% near outer wall air plenums. During unloading, this 2-3% moisture spread between kernels will mix and blend to within 0.5-1.0%. High-temperature, high-airflow cross-flow narrow (10-15 inch) column dryers typically have moisture differentials of 5-8% moisture between kernels at inner and outer perforated metal walls, which end up in storage with a wider final moisture differential between adjacent kernels.

Cross-flow aeration research in high depth-to-diameter ratio (3:1 to 6:1) silos at Oklahoma State University (Day and Nelson, 1962) in the early 1960s demonstrated that moving the same volume of air horizontally between two ducts on opposite sides of a silo required much less power and static pressure compared to the same airflow moved vertically the full height of the silo. In a 20 ft. ID×120 ft high silo, horizontal airflow moves 18-19 ft versus 120 ft vertically, a 1:6.7 diameter to height ratio. However, there is a large disparity (about 1.0:1.7 ratio) between the minimum air path directly across the middle of the silo compared to the air path following the inside silo wall (Noyes and Navarro, Editors, 2001). With the vertical center aerator discharge in all directions to wall exhaust plenums, taught in this new technology, all air paths are about the same length, so all grain receives approximately equal drying treatment.

A major problem with conventional cross-flow aeration is that silos have to be full for the cross-flow aeration to work properly. Reed (2004) describes a new patented concept of 2-duct cross-flow aeration in concrete silos. He uses a series of controls to deal with silos which are full versus not totally filled. However, as taught by Reed, the airflow and cooling zones are not uniform across the silo cross-section.

This new cross-flow aeration and drying technology involving high air-flow delivery from a central vertical aerator tube, with low static pressure, low fan power and uniform airflow, which can operate efficiently at variable bin fill levels (once grain fill exceeds 25 to 30% of the bin), taught in this patent, will be highly beneficial to worldwide grain storage systems for low cost in-bin grain drying, or for aerating grain in storage bins at high aeration rates, or at much higher drying airflow rates suitable for low cost, efficient in-bin natural air grain drying.

A new biological moisture removal phenomenon was learned during tests by Danchenko on a prototype in-bin dryer taught by this patent technology whereby heated air drying was followed by ambient air drying time of about 20-25% of heated air time (Example: 2.5 hours heated air drying at 15-20° C. temperature rise, followed by 0.5 hours ambient air drying). Danchenko repeated this heated versus non-heated air drying through multiple cycles, resulting in faster drying than with the same total length of drying time with continuous heat. This "pulsing" effect of heating grain, then cooling the grain for a short period, allowing the grain to "rest" and continue to dry using the residual grain heat between heated air cycles, resulted in an increase of 15-25% faster drying.

For safe grain storage, interstitial air equilibrium relative humidity (ERH) must be below 70% RH; 70% ERH is a critical value of water activity which defines safe upper interstitial storage air humidity limits of biological products. Microbial activity is restricted on biological products when water activity (seed, kernel or grain interstitial air humidity) remains below 70% ERH. Product temperature and moisture content are both used to determine ERH levels for biological products.

For in-bin cross-flow drying, an optional design goal is to dry continuously from relatively low fill levels (20-25%) until the bin is full to allow immediate protection of freshly harvested grain. 'Partial-fill' drying allows the dryer system to begin rapidly reducing grain moisture soon after wet grain reaches the drying-storage bin, quickly protecting it from mold, instead of waiting until the drying bin is full, which might mean that the partially filled bin might set for several days if harvest is interrupted by inclement weather, and the grain waiting to be dried might begin to mold. Early drying helps avoid late season storm losses.

Grain producers can dry very wet grain as soon as it can be safely harvested using this novel in-bin drying technology, because the primary power energy required is electrical energy to operate the ambient airflow system. Example: Corn is ideal for shelling between 26-28% moisture content, but can be harvested as high as 30-31% with minimal shelling damage. High moisture corn gives off surface ("free") moisture at a very rapid rate to natural air, even with ambient air relative humidity of 70-80%, until kernel moisture drops to 23-24%. A typical fan "heat of compression" temperature rise of 3° C. (5.0° F.) will change 15° C. (59° F.), 70% RH air to 18° C. (64° F.) at 52-54% RH, suitable for drying corn to 11.5-12.0% final m.c. This drying method is ideally suited for drying food grade and ethanol fuel grains.

It may be desirable for an in-bin drying system to selectively condition grain in different vertical sections of the bin. Example: As grain moisture in the bottom of the bin is lowered, and higher moisture grain is added, airflow can be increased on the wetter grain while reducing airflow to the partially dried bottom grain, especially after lower grain drops below 70% ERH. This in-bin dryer process can be designed to allow variable airflow rates at selected vertical sectors of the dryer by control of input air through separate compartments of the vertical aerator pipe as taught in FIG. 5, or by controlling the exhaust levels of the dryer with vertically segmented air plenums, as taught in FIG. 1, or by control of multiple exhaust vent levels with a full height cylindrical plenum as taught in FIG. 2. 70% ERH moisture contents at 16° C. and 32° C. for wheat range from 13.9% to 13.0%, corn moisture ranges from 14.1% to 11.6%, and sorghum varies from 14.1% to 13.5%. At 15° C. and 35° C., soybeans moistures vary from 12.4 to 11.7% (ASAE Standards, 1993).

Valuable research, which further clarifies horizontal airflow conditions, was conducted during the early 1990s by Jayas and associates at the University of Manitoba (Jayas and Muir, 1991; Jayas and Mann, 1994). They discovered that horizontal airflow through elongated seeds and kernels, maize (corn), wheat, sunflowers, barley, rice, edible beans, etc., has 40% to 50% less airflow resistance than when the same airflow rates are moved through the same vertical distance. Thus, only 50 to 60% as much fan power is required to aerate or dry long grain or seeds with horizontal airflow compared with the same distance of vertical airflow. When aerating relatively round seeds—soybeans, sorghum (milo), millet, etc., the researchers found the airflow resistance was the same for vertical versus horizontal airflow.

SUMMARY OF THE EMBODIMENTS

The new cross-flow air movement drying and aeration technology has been developed where airflow is discharged horizontally from a vertical perforated aerator tube essentially in the center of the bin. Airflow paths radiate from the center and flow directly to perforated sidewall plenums. The vertical aerator tube and sidewall plenum designs can each be of several alternative configurations, some of which are illustrated in FIGS. 1-8.

Each horizontal airflow path length is less than the radius of the steel bin. Because of the much shorter horizontal distances, airflow rates can be much higher while using the same fan motor power, compared to vertical full bin grain depth aeration or drying as demonstrated in Tables 1 and 2. Combining a center vertical perforated aerator pipe to provide cross-flow airflow with controlled sidewall exhaust outlets in sealed bins can allow aeration or drying of partially filled bins and continuation of drying or aeration while the bin is being filled periodically or continuously, and allows drying or aeration of selected levels of grain in full or partially full bins. Thus, controlling airflow rates through sidewall and roof exhaust vent air-valve openings in some batch dryer configurations can allow higher moisture grain layers to be dried while lower moisture grain receives reduced airflow or no airflow. The addition of a supplemental modulated heat source with computer, thermostatic or timer control to add low to moderate temperature heat to drying air can allow for uniform grain and seed drying day and night without kernel or seed germination damage.

Hopper-bottom in-bin dryers (FIGS. 1, 2 and 4) allow rapid dry-grain batch transfer to storage bins for efficient, economical drying of food and feed grains and seeds. In-bin dryers in flat bottom steel bins (FIGS. 3 and 5) can use fluidized conveyor channels (best seen in FIG. 5) for fast unloading of the remaining cone of grain after gravity flow is completed.

Farmers and elevator operators with in-bin drying and storage can further reduce losses by earlier than normal harvest. This in-storage drying technology design can also be developed into retrofit kits to convert thousands of existing steel storage bins into efficient in-bin aeration or dryer systems for much faster aeration cooling or natural air drying using minimal fan power. Converting to high speed cross-flow aeration can give farmers and elevator operators much better control over their stored grain and seed products.

An important primary feature of the preferred in-bin cross-flow natural air and supplemental heat drying system is for the bin dryer to be configured with inlet and outlet conditions whereby the dryer operates with a continuous flow of grain. Thus, the time normally used for periodic loading and unloading of the holding volume of the dryer is eliminated, making the dryer much more efficient. The same configuration dryer can also be operated as a continuous recirculation batch treatment system, which is a preferred method of operation when used with an ozone pre-plant seed treatment system to sanitize seed grain prior to planting, as an alternative to traditional seed treating chemicals. Another desirable feature of the continuous flow in-bin dryer is that the dryer can be configured with airflow in the upper portion of the dryer which is much hotter than can be tolerated by the grain in the middle or lower parts of the dryer.

Very moist grain, above 23-24%, which has "free" surface moisture, tends to "evaporative cool" as the surface moisture is removed. Thus, during the early portions of drying, the moist grain kernel temperature rises slower than if drying the grain was started at lower moisture content where the grain did not have free surface moisture. Whereas the heat applied to grain below 23-24% moisture should be held to a moderate drying air temperature level, such as 45-50° C. (113-122° F.), very moist grain can be exposed to high airflows of 60-70° C. (140-158° F.) air temperature without germination or kernel heat damage until the grain moisture approaches the 23-24% level. Then air temperatures should be reduced to maintain kernel temperatures below 40-45° C.

Because the grain flows continuously, if there is variability in the airflow or drying air temperature at various levels of the vertical aerator pipe system, all grain will be exposed to the same drying conditions, whereas with batch drying, where grain is stationary in the dryer throughout the drying process, such variations in airflow and temperature would cause significant variations in final grain moisture levels at different grain levels in the bin.

Another feature of the continuous-flow in-bin dryer is that it is fitted with a grain diversion or modulation device, which may be adjustable to regulate the flow of various types of grain, which causes the vertical grain flow to operate as "plug-flow" where all grain moves relatively uniformly downward at a constant rate.

Although the dryer is considered to be a "continuous-flow" type, it can be further configured to operate as an intermittent flow system whereby the downward grain flow is interrupted periodically when such process is determined to be advantageous or desirable.

Two additional product storage improvement and quality maintenance features of the preferred embodiment are: (1) the application of ozone in conjunction with natural air drying or aeration airflow to control and oxidize mold spores, microbial elements, fungus and toxic materials, as well as kill or expel storage insect pest populations, the continuous dryer can be configured as a recirculation batch dryer where thorough mixing of the grain kernels by recirculating grain back through the dryer multiple times is preferred for uniform treatment, such as during ozone seed treatment to sanitize microbes on seeds for improved germination and production yields; (2) the incorporation of a very small, low-power (1/12-1/3 HP centrifugal fan) air recirculation system in the sealed structure which has a primary purpose of improving long term storage of grain that is stored in the bin dryer by keeping grain temperature and moisture equalized throughout the structure by continuous or periodic movement of air at a rate of about, but not limited to, one air exchange per 4 to 48 hours, the air recirculation system moving air preferably, but not necessarily, from the headspace by suction to the base of the sealed structure, into the sealed primary aeration or natural air drying system operating as a low airflow closed loop aeration system, the process to minimize or eliminate "moisture migration" and molds that develop from such moisture concentrations by maintaining uniform grain temperature and grain moisture levels in sealed storages, thus no grain moisture is lost while grain security is enhanced.

Yet another preferred feature of the in-bin cross-flow dryer is that it can be operated totally on electrical energy (but also can be configured with fuel burning heaters when that is desirable) for operating the drying fans as well as providing supplemental electric resistance heat to the airflow stream in locations where electrical power is readily available, but gaseous or liquid fuels may be more expensive and difficult to obtain. This feature makes this dryer suitable for remote operations, where operation can be powered and operated by an on-site engine driven electric generator.

DETAILED DESCRIPTION OF THE PREFERRED EMBODIMENTS

Figure 1:
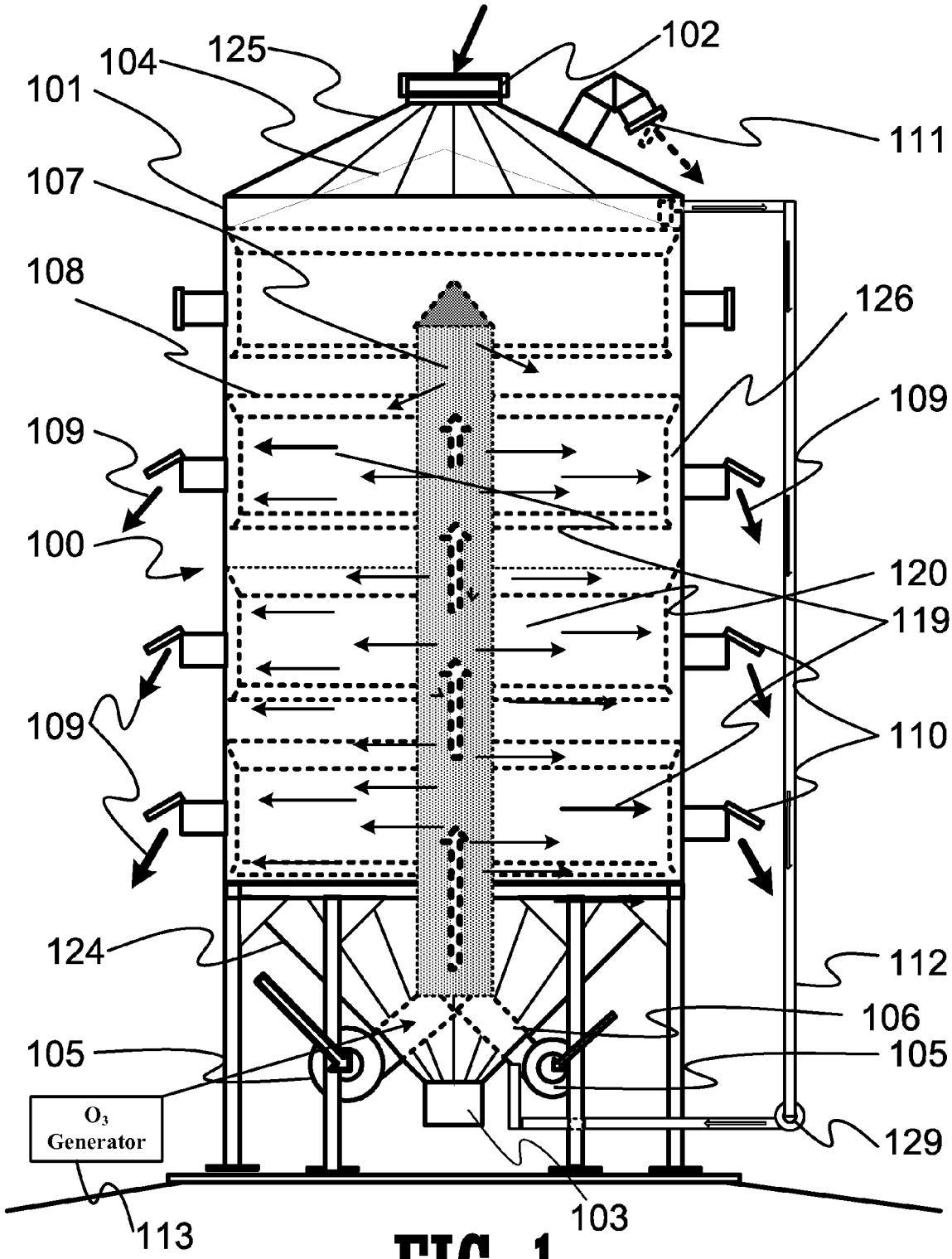
FIG. 1 is a cut-away side view of the cross-flow hopper bottom in-bin drying system with natural air drying and/or aeration fans with multiple individual full diameter perforated cylindrical sidewall plenums spaced vertically from bin base to roof, and a very low airflow closed loop air recirculation system communicating from roof headspace to base.

This novel technology can be used, but is not limited to use, in a bolted corrugated galvanized steel bin 100 fitted with a perforated center aerator tube 107 of suitable diameter and percentage perforation with one or more compartments which can be supplied by one or a plurality of air delivery tubes, pipes, ducts or other suitable air and gas communicating means. The vertical aerator tube 107 extends from near the bin base to nearly all the way to the roof-sidewall junction level. Air from the center vertical aerator can communicate through the grain or other granular materials to a variety of perforated, slotted or overlapped air receiving panels, which form alternative short cylindrical 108, full height cylindrical 120, formed V shaped 121, or half-round 122 air plenum chambers used on different configurations of said in-bin drying means. The exhaust (or receiving chamber in the case of air drawn through the grain from the outer walls to the center aerator pipe and exhausted to the outside from the center pipe) short cylindrical 108, full height cylindrical 120, formed V shaped 121, or half-round 122, 123 air plenum chambers positioned near and connected to the structural outer wall of the bin, to receive the moist airflow from the drying bed of grain 104 and provide a means for exhausting this air through a variety of controlled or controllable air vents 110, 111, air valves or other suitable means of control of the air so the air flows at any or all desirable levels more or less, but not necessarily horizontally from aerator pipe to exhaust sidewall plenum, see FIGS. 1-8.

In another embodiment, the grain storage aeration and drying system is comprised of a storage container 100 which includes an impervious base or bottom structure 124, an impervious sidewall structure 101, and a partially sealed roof structure 125; wherein the storage container holds a granular biological product 120; wherein the granular biological product 120, forms a top biological product surface 104; an air moving means 105 to force the air, or a mixture of air and another gas or gases communicating through a connecting duct 106 into the base of the vertical aerator tube 107, then in a mostly horizontal or cross-flow process through the moist granular biological product 120 held in the storage container 100 for purposes of conditioning, improving storage and maintaining the granular biological product 120.

In this embodiment, it is conceivable that air could flow from the central aerator tube 107 through a perforated bin wall, where the entire outer structural bin wall 101 is perforated, without interior plenums, but where solid sections of material can be maneuvered or caused to block the exhaust perforations of selected sections of the bin, allowing drying to take place with all air flowing thru a partially filled bin 100, or that the selected sections of the bin perforated wall can be blocked in such a manner that drying of grain in a selected vertical cylindrical section of a full bin of grain could be accomplished. The storage container 100 is charged with grain through a bin fill opening 102. It is also conceivable that the entire inner wall 121 may be perforated with an air space of suitable dimension to provide a plenum for collecting exhaust airflow 109 as it exits horizontally from the grain, as illustrated in FIGS. 2, 3, 5, 6 and 7. The perforated cylinder 121 extends to within close proximity of the roof 125 of the drying bin, such that grain could not flow over the top and fall into the air chamber 126, but exhaust air 109 could freely flow up out of the space 126 between outer wall and perforated cylinder and through the bin headspace between grain surface 104 and under side of roof 125, exhausting through roof exhaust vents 111, or through a suitable spaced gap between the top of the sidewall 101 and the roof 125, where the roof is not secured and totally sealed to the top of the outer structural wall 101 of the bin 100.

One embodiment comprises short vertical sections of cylindrical perforated plenums 108, FIG. 1, where the perforated wall panels 108 are spaced away from the outer wall to form a shallow air plenum 126 with short vertical gaps between the perforated plenums, or with the short vertical plenum sections 108 contacting each other, where each plenum level has one or more vents 110 which communicate the exhaust air 109 through the outer bin wall, where the vents 110 have means of opening, closing or adjusting to a desired percent opening by stages, from fully open to fully closed, whereby the vents 110 provide control of the volume of exhaust air 109 through that cylindrical section of grain in the bin, such that each vent or set of vents 110 at each plenum level is controllable at each level to selectively proportion the amount of drying air 109 passing through each selected cylindrical section or level of grain. The sidewall vents can be manually or automatically controlled to optimize drying based on the moisture level of grain 120 in a cylinder of grain adjacent to each plenum level as detected by moisture sensors in each level which communicate to the drying controller, which modulates airflow 109 and supplemental heat to maximize drying rate and grain moisture uniformity. In addition to the sidewall vents 110 at spaced elevations vertically, one or more adjustable vents 111 are also mounted to communicate through the roof 125 to allow control of airflow through surface 104 grain 120, FIGS. 2, 3, 4, 5 and 6, whereby some air from the upper section of the vertical aerator tube is induced to flow at an angle through the upper level grain 120 near the surface 104, such that a flow of drying air passes more or less perpendicular and uniformly through the grain surface 104, thereby drying the grain 120 in the peak or top surface 104 of the grain.

The individual levels of the perforated inner wall air plenum ring sections 108 (FIG. 1) have a sloped top and bottom which provides structural rigidity, with the perforated plenum ring section being braced substantially against a structural wall flange spacer to withstand the lateral and shear pressures of the grain. Each plenum cylindrical section 108 either integrally formed to the wall or is bolted to the wall via a structural bracket between the structural outer wall 101 and the perforated panel 108 for structural rigidity. The circular perforated ring sections 108 are braced from the outer wall to withstand bulk grain 120 shear forces and lateral grain pressures. Perforated cylindrical panels 108 may be spaced with short vertical separations from plenum sections above and below for selective air flow control, FIG. 1, or plenum panels may be in contact with the panels above and below, wherein airflow passing between the upper and lower plenum sections will turn and flow into the nearest plenum 108, when the plenum has a discharge vent valve 110 open to allow airflow 109 through that plenum. The amount of opening of the exhaust vents 110 at each level controls the percentage of total fan drying airflow 109 that passes through the cylinder of grain 120 in that section. One or more roof vents 111 would allow air to pass through the grain surface 104 if the top of the vertical aerator tube 107 is immersed in the grain. This causes airflow near the grain surface 104 to flow diagonally—approximately perpendicular to the grain slope, compared to primarily horizontal airflow through grain 120 in most sections adjacent the sidewall plenums 108, 121, located substantially below the grain surface 104.

To facilitate maximum use of the in-bin dryer for batch or continuous flow drying with high airflow rate and low temperature supplemental heated drying, primary drying is done to lower the grain moisture to about 80-85% ERH, (2.5-5% grain moisture content above 70% ERH levels). Then the grain 120 can be cooled and transferred, or transferred without cooling, to supplemental storage bins which have cross-flow aeration (with smaller perforated center aerator tubes, smaller fans 105 and much lower airflow rates than the drying bins—such as 0.35-0.5 CFM/bu) to continue slowly reducing grain moisture to about 65-67% ERH for long term safe storage by high airflow aeration. These supplemental storage bins are equipped with aeration systems, with smaller vertical perforated aerator pipes 107 and proportionately smaller fans 105, plenum and roof vent 111 components, and have flat bottom floors for economy of storage costs, as illustrated in FIGS. 3 and 5. However, hopper-bottom 124 drying bins (FIGS. 1, 2 4 and 6) may be preferred for complete rapid cleanout of each batch of dried grain through bin discharge 103.

Another embodiment of this in-bin dryer technology is shown in FIGS. 2, 3, 5 and 6. This version of bin has a full wall height inner perforated cylinder 121 which will be the primary structural containment for the grain mass. With a full height inner perforated wall 121, less vertical grain loading is transferred to the outer sidewall 101, compared to corrugated steel walls in direct contact with the grain bulk Since the in-bin dryer assembly 114 of air plenum and center vertical aerator pipe 107 are designed to fit into standard commercial steel bins, standard corrugated steel grain bins 100 are likely the ideal outer structural shell 101 due to the standardized manufacturing and assembly costs of competitive steel bins in the grain industry. Vertical multiple V-shaped 122 or half-round 123 shaped ducts with side flanges, (FIGS. 4 and 8) are designed for ease in initial factory assembly, or as an economical retrofit kit for existing grain bins which can be converted in situ at existing grain storage facilities which need economical drying systems.

Sidewall vents 110 and roof exhaust vents 111 each comprise an adjustable air valve so exhaust air 109 volume can be proportionally controlled at each level of the sealed dryer. Thus, as grain 120 fills the bin 100 and passes the first row of exhaust vents 110 (FIGS. 1, 2 and 3), drying can begin at the first plenum level, and continue in selected vertical sections of the bin as it fills, based on grain moisture at these levels.

The full height center vertical aerator tube 107 distributes drying air horizontally 119 and radially through the cylinder of grain 120 directly to the outer perforated wall exhaust air plenums. As air 119 "fans out" horizontally from the vertical aerator pipe, the air velocity gradually slows, providing increased cooling or drying air residual time as it passes from the inner to the outer grain. This radial airflow 119 pattern is "ideal" for a cross-flow dryer. The air accelerates through the grain 120 immediately against the aerator pipe. Air passing through each equal area of the grain mass spends the same amount of time in each volume of grain, allowing for a relatively balanced drying process. By the air 119 accelerating through the inner grain 120, less drying heat energy is absorbed close to the aerator and more is available for drying moisture from the grain closer to the outer sidewall 101. Less grain moisture is absorbed by drying air 119 close to the aerator pipe per foot of travel compared to grain near the outer wall 101.

Figure 4:
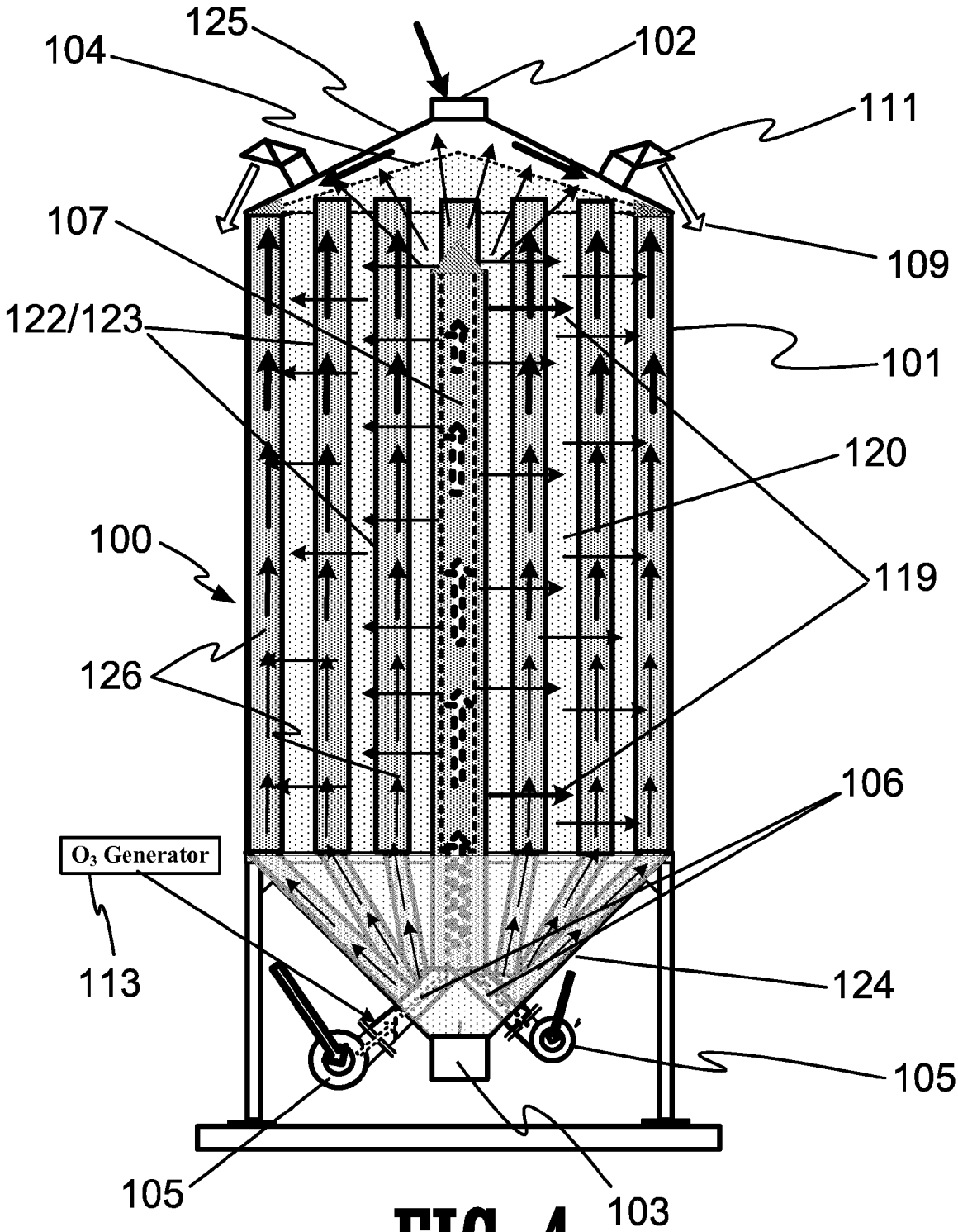
FIG. 4 is a cut-away side view of cross-flow hopper bottom in-bin drying system with natural air drying and/or aeration fans with multiple individual perforated vertical sidewall plenum chambers. Drying bin airflow system has provision for ozone supply connection for treating grain.
Figure 5:
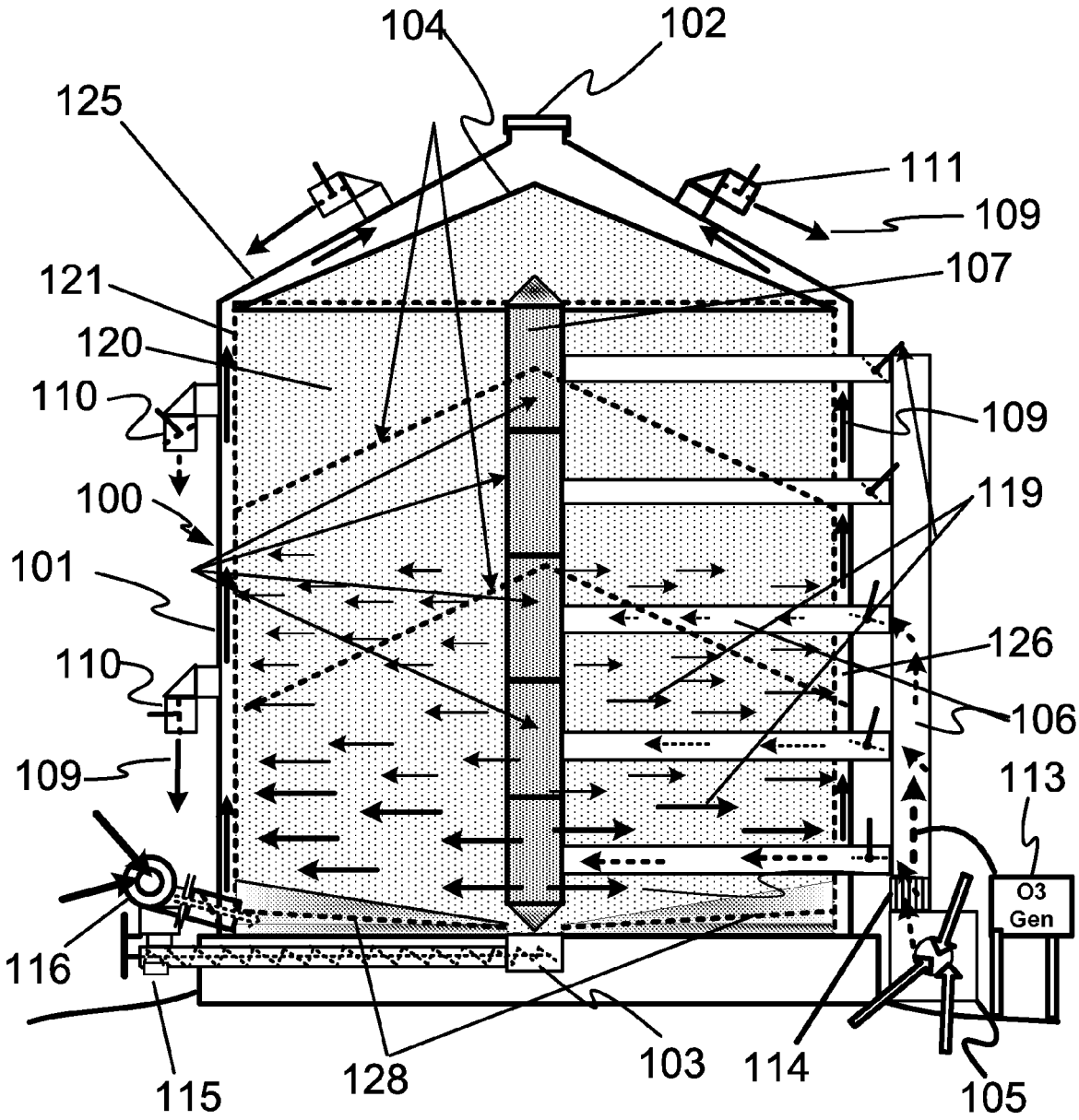
FIG. 5 is a cut-away side view of cross-flow flat bottom in-bin drying system with natural air drying and/or aeration fans, full height cylindrical sidewall plenum and separate vertical aerator tube sections with individual air supply pipes and a fluidized bed cleanout floor with fan.
Figure 6:
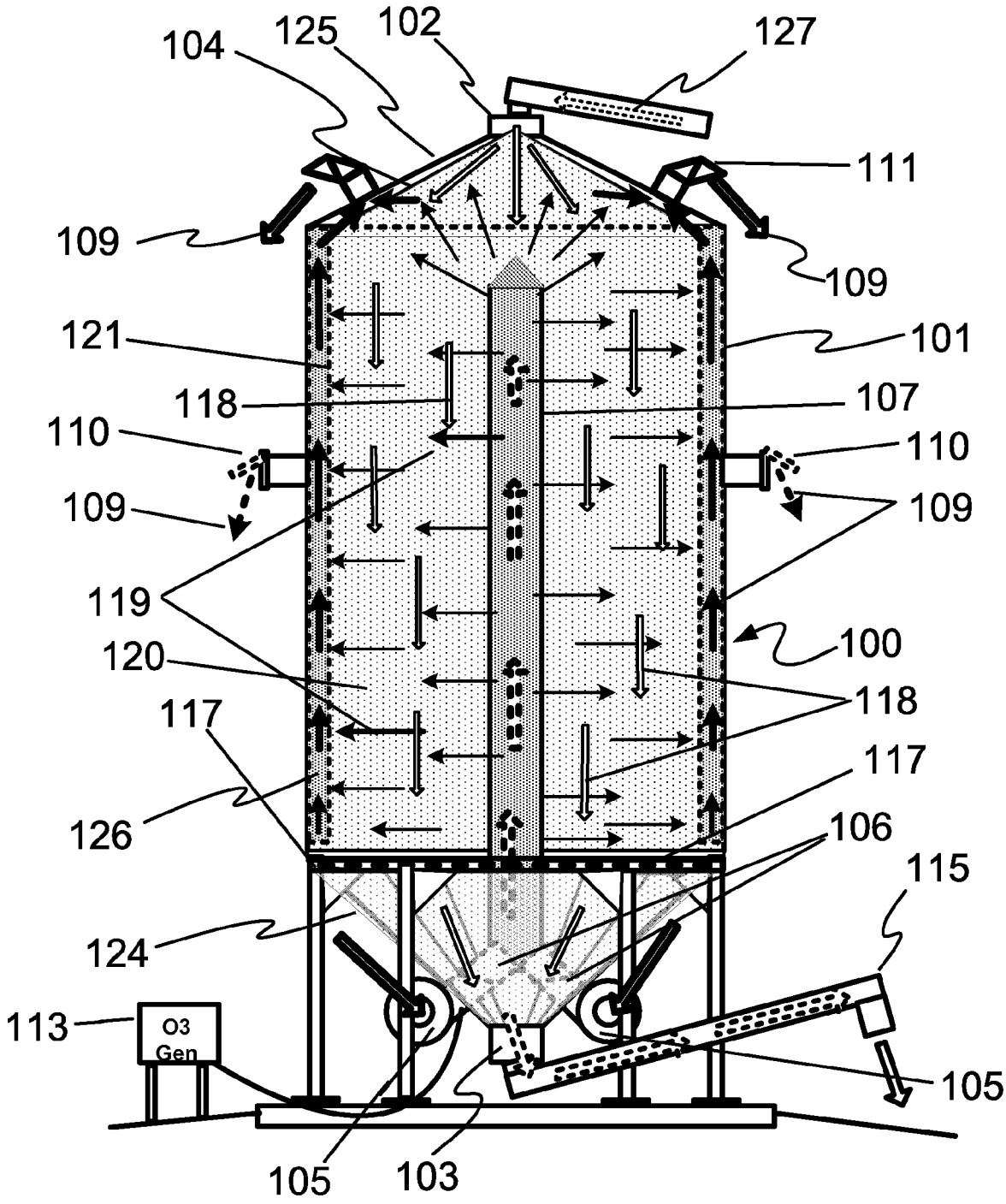
FIG. 6 is a cut-away side view of cross-flow hopper bottom in-bin continuous-flow drying system with natural air drying fans with full height perforated cylindrical sidewall plenum.
Figure 7:
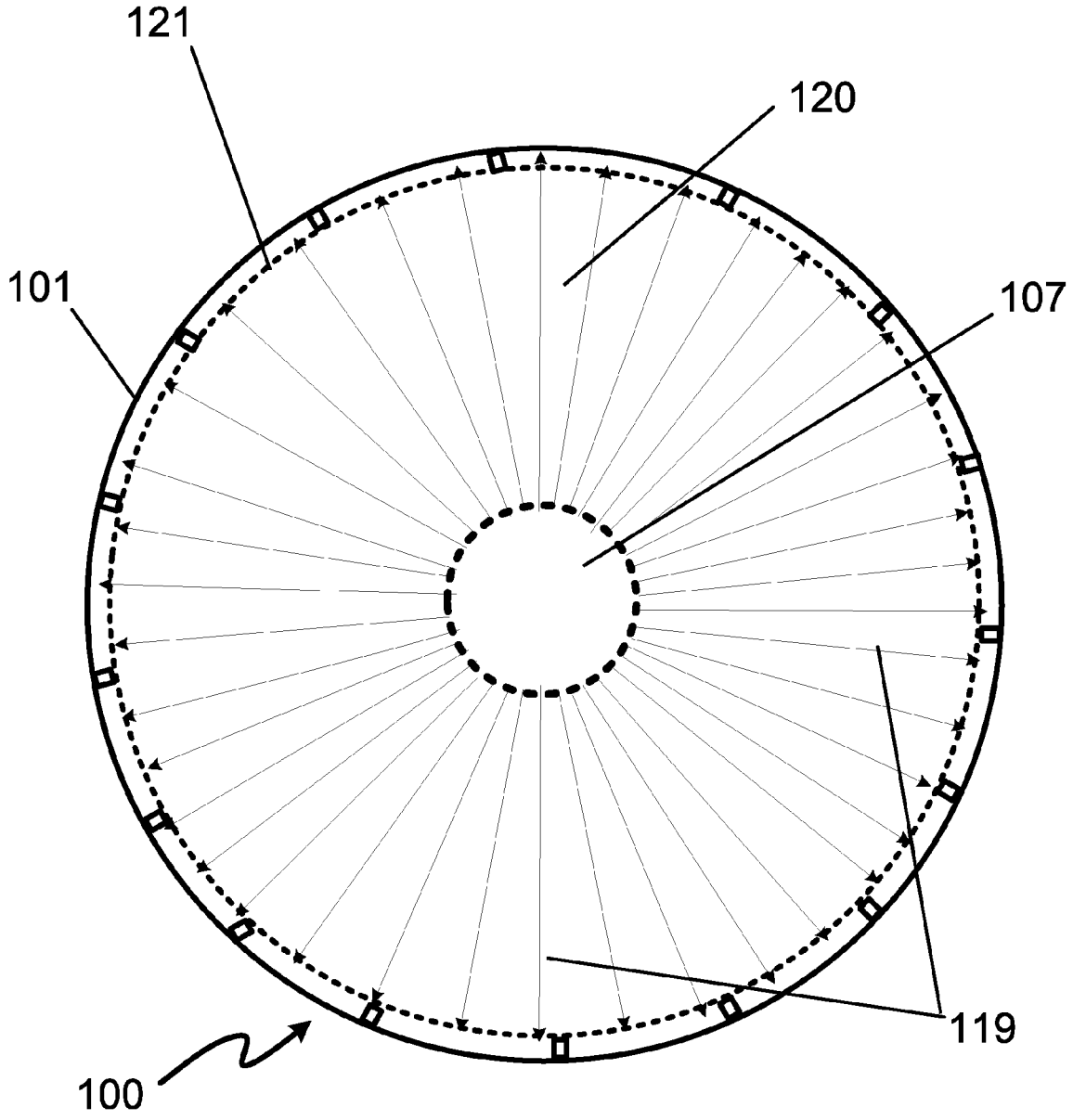
FIG. 7 shows the cross-flow air path patterns from perforated vertical center aerator tube to perforated vertical full height cylindrical sidewall plenum duct (FIGS. 2, 3, 5, 6) or separate short vertical cylindrical perforated plenums spaced at intervals (FIG. 1), connected to outer bin wall.
Figure 8:
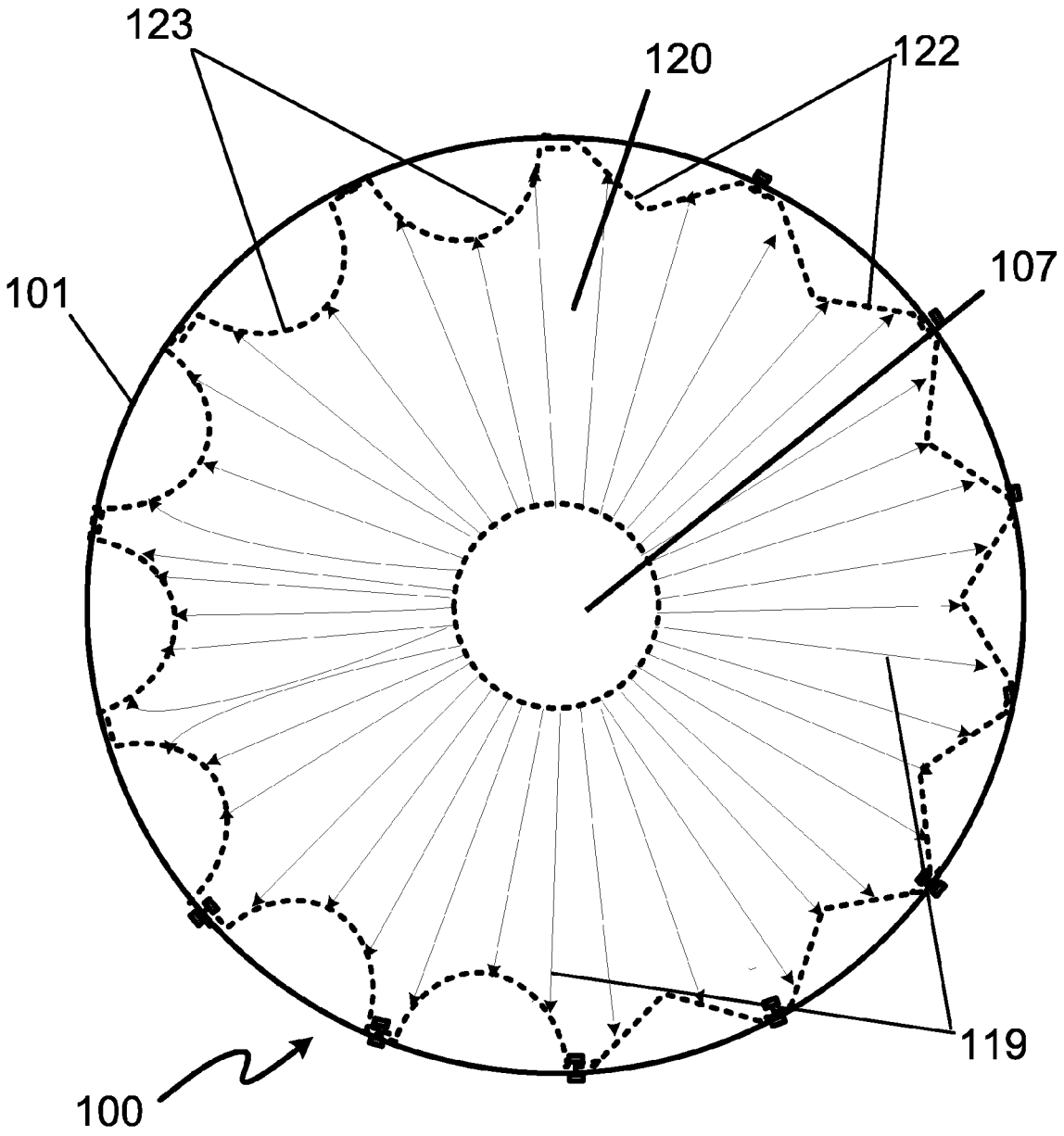
FIG. 8 shows the cross-flow air path patterns from the perforated vertical center aerator tube to vertical perforated formed angular or convex sidewall plenum ducts connected to outer bin wall as shown in FIG. 4 wherein the formed vertical sections can be placed together with sidewall flanges overlapped for more uniform airflow distribution through grain, or can be spaced apart for aeration or slow drying.

Another embodiment is comprised of a hopper or flat bottom corrugate steel bin, with a vertical center aerator tube 107 of desired size for the airflow, whereby the sidewall plenums are made of vertical rolled half round, domed, convex perforated panels 122 , or V-shaped formed sections 121 of perforated material with flanged sides for easy sidewall attachment, FIGS. 4 and 8. These vertical perforated wall panels 121, 122 are bolted to the outer structural bin wall 101 (see FIG. 8) with the bottom extending to near the floor for flat bottom bins or to near the top of the hopper 124, with possible sections of the same materials attached to the hopper surface 124 and extending a substantial distance down toward the bottom of the hopper 124, the sections may be of smaller size or fewer sections. In one embodiment, alternate sections run down the hopper slope, with half of those (alternate pieces) stopping half-way down the hopper 124 slope. Since only the initial airflow is required to be collected in order to aerate the grain, this embodiment is comprised of a suitable connecting perforated section to communicate the air flow from the hopper slope to the base of the vertical plenum section.

Sidewall vertically formed perforated plenum sections 121, 122 are designed to overlap periodically as a means of assembling the sidewall of the drying or cooling bin, with the upper section of the formed plenum extending up against, or almost against the sloped roof panels 125, such that airflow being conveyed upward to the bin headspace can flow into the headspace then into the open roof-sidewall eave gap or roof vent 111 closest to the plenum section for exhausting, drying or cooling airflow. The top or upper end of the formed vertical plenum sections will extend past the level of intersection of the sidewall by the grain surface 104 when drying bin is at its maximum capacity of all types of grains and seeds. In one embodiment, if the inner perforated cylinder plenum walls are 40 feet diameter, and the vertical aerator is 6 ft in diameter, the horizontal air paths are (40−6)/2=17 feet long. In a conventional 40 ft diameter bin, with 68 ft sidewalls, vertical air paths will be 4 times as long.

It may be desirable to use square or rectangular bins for in-bin cross-flow drying. If that is an economical option, then the same types of alternative sidewall plenums (with perforated plenums mounted on closest opposite sides) and controls will apply.

An alternate mode of application of this technology is where the air flow enters the open inlet vents 111 in the roof of the structure, passes down through the plenum cavities 126, then turns and enters the grain, flowing horizontally 119 to the center perforated aerator tube 107, which extends substantially from the bottom toward the top of the structure. This process of using suction airflow provides added benefit for some selected applications where the exhaust air can be easily controlled and can be routed through other processes for other purposes where humidity from the drying process is desirable. In addition, yet another alternative operation mode involves the application of ozone in conjunction with natural air drying or aeration airflow to control and oxidize mold spores, microbial elements, microbes on grain kernels and seeds, fungus and toxic materials, as well as to kill or expel storage insect pest populations. The ozone generator 113 would be positioned adjacent the primary airflow means with the ozone supply tubing connected in one embodiment just downstream of the drying or aeration fan 105, as best shown in FIGS. 1, 2, 3, 4 and 6.

Figure 2:
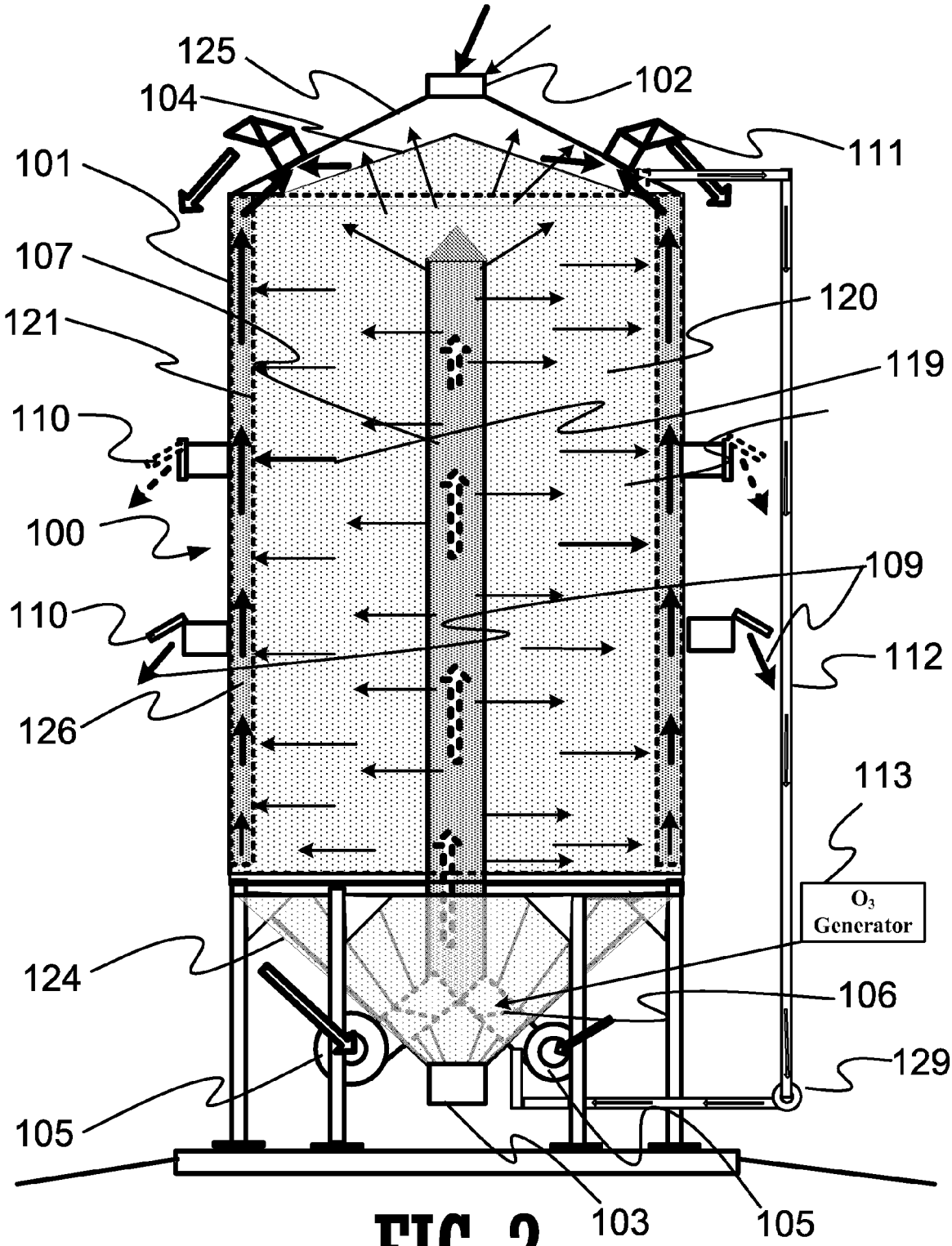
FIG. 2 is a cut-away side view of the cross-flow flat bottom in-bin drying system with natural air drying and/or aeration fans with a full height perforated cylindrical sidewall plenum spaced from the outer structural wall with vertical stiffener brackets, extending from the top of the bin hopper to near the roof eave, and a very low airflow closed loop air recirculation system communicating from roof headspace to base.
Figure 3:
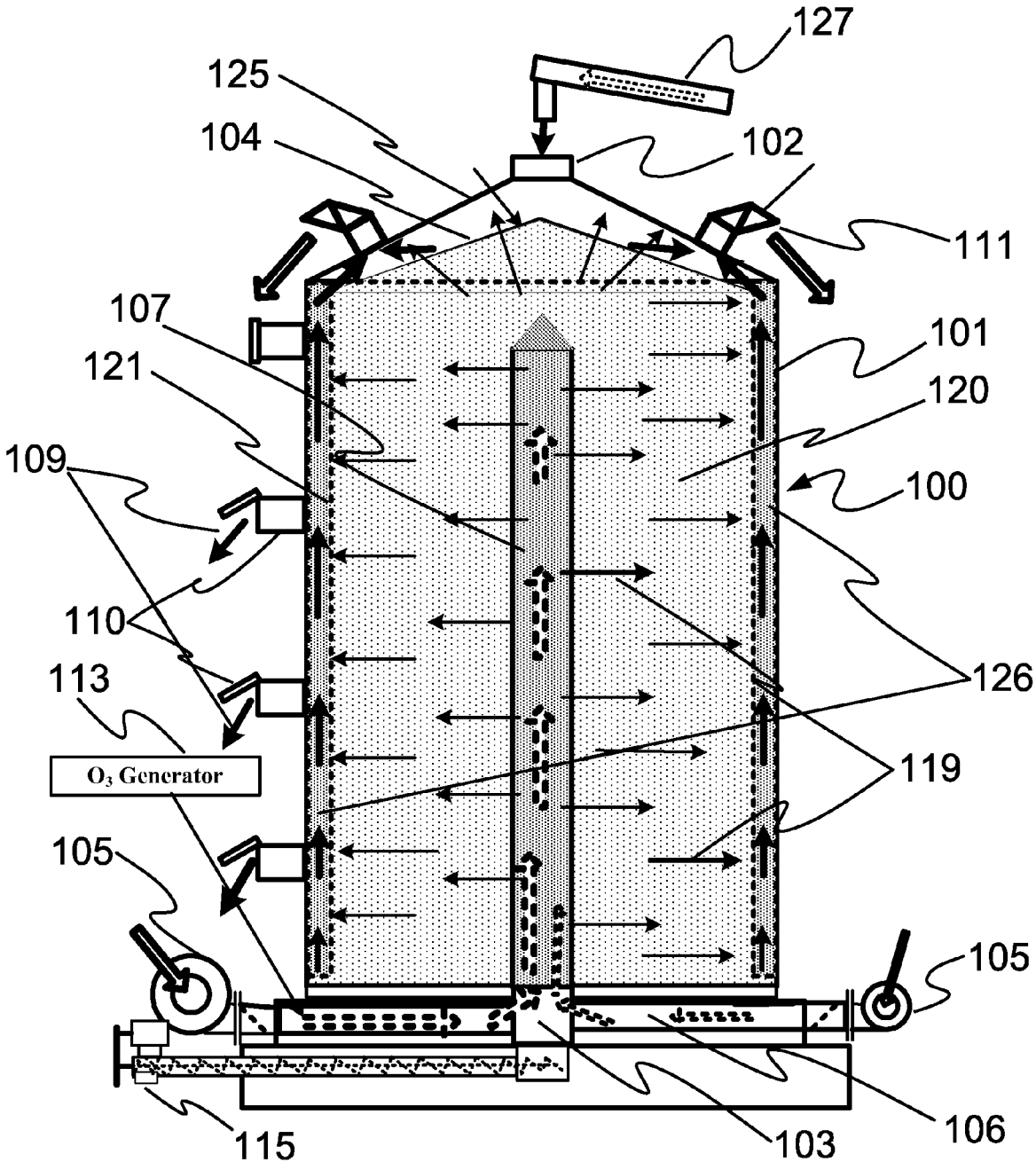
FIG. 3 is a cut-away side view of the cross-flow flat bottom in-bin drying system with natural air drying and/or aeration fans with a full height perforated cylindrical sidewall plenum spaced from the outer structural wall with vertical stiffener brackets. Drying bin airflow system has provision for ozone supply connection for treating grain. (The ozone system can be incorporated on all versions of the dryer, FIGS. 1-8.)

Yet another improvement of the after-drying storage maintenance of the dried product is the incorporation of a very small, low power (1/12-1/3 hp) fan 129, economical air recirculation system, best shown in FIGS. 1 and 2, which has a primary purpose of improving long term storage of grain 120 by keeping grain temperature and moisture equalized throughout the sealed structure by continuous or semi-continuous fan system 112 controlled movement of air at a rate of about, but not limited to, one air exchange per 4 to 48 hours, the air recirculation system 112 preferably moving air from the headspace by suction to the base of the structure, into the sealed primary aeration or natural air drying system, the process to minimize or eliminate "moisture migration" and molds that develop from such moisture concentrations by maintaining uniform grain temperatures and moisture levels, but with the option of moving airflow from base 124 to underroof 125 headspace for a purpose such as transfer of low to moderate concentration of ozonated air directly into the headspace of the storage to provide a modified atmosphere which is not desirable by insects, an important storage management feature for storage units with leaky roof headspaces which might otherwise by entered by insects.

A further improvement of the in-bin dryer incorporates a means of metering 117 grain uniformly across the base of the grain mass such that the grain flows continuously and uniformly downward, or the metering means 117 may be designed and operated to provide continuous but not necessarily uniform downward grain flow, whereas the metering system 117 may cause grain nearest the center aerator tube 107 to flow faster compared to grain nearest the outside exhaust plenum wall, with the inside grain flowing substantially faster, thus providing a gradual increase in vertical grain flow between outer wall 101 and aerator tube 107, the variation in grain flow to provide longer exposure to drying in the outer grain which receives drying air which has already given up part of its drying energy to the fast moving grain near the pervious aerator tube 107, such that moisture level of all discharged grain is approximately uniform.

Table 1 compares air volumes and power between vertical and horizontal airflows in an 8 m dia×20 m sidewall height bin aerating 5 types of grain and oil seeds. Five aeration airflow rates were checked comparing conventional vertical aeration with cross-flow horizontal aeration. Using the same fan power for horizontal as vertical airflow, cross-flow systems moves 4 to 9 times as much air volume with only 20 to 35% as much static pressure. It is clearly apparent that air systems with elongated seeds (maize, wheat and sunflowers) developed higher airflow rates with cross-flow systems than the two spherical type seeds. These ratios are directly related to the vertical aeration grain depth compared to horizontal distance from the vertical aerator tube wall to the perforated sidewall air exhaust plenums. With elongated seeds, the 'equivalent' airflow path is conservatively considered to be only 60% as long as the path for round seeds, as reported by Jayas and research associates in Canada. (Jayas and Mann, 1994; Jayas and Muir, 1991)

When considering horizontal cross-flow aeration or drying in a specific grain volume at a selected fan power level, airflows will be higher and static pressures lower through smaller diameter, taller bins than for the same grain volume in shorter, larger diameter bins.

Table 2 compares power and static pressure requirements for vertical versus horizontal (cross-flow) air movement for several sizes of bins, comparing three long kernel grains and oil seeds (maize, wheat and sunflowers) and two round kernel grains or seeds (soybeans and sorghum) using the same airflow rates.

The important point in Table 2 is that relatively high airflow rates can be developed with low static pressures in large, upright bulk storage units. With proper design, it is economically feasible to conduct major drying efforts in large bulk bin dryers which can be easily unloaded and reloaded, or can be operated with continuous grain movement (continuous flow dryers) for relatively high-volume low-energy drying. The final column in both tables lists the H/V Ratio. This H/V ratio compares horizontal airflow to vertical airflow, using the same fan power on both vertical and horizontal airflow bins to compute the data for that line of the table.

These data in Tables 1 and 2 were developed using the FANS program developed by Dr. Bill Wilcke, Professor of Agricultural Engineering, University of Minnesota, St. Paul, Minn., and Dr. Dirk Maier, Professor and Head, Grain Science Department, Kansas State University, Manhattan, Kans.

This cross-flow in-bin drying and aeration technology has the potential for use in retrofitting existing steel bins to this more efficient airflow design, thereby converting existing structures with limited utility into highly efficient, highly productive, low energy consumption tower grain dryers.

The grain storage aeration and drying system is further comprised of a vertical pervious aerator tube comprised of an upper end and a lower end and placed essentially in the center of the storage container with the vertical pervious aerator tube 107 surrounded by the stored biological product 120 with the vertical pervious aerator tube 107 extending to substantially beneath the top biological product surface 104 when the biological product is at maximum depth. The air moving means 105 comprises one or more fans or blowers capable of delivering an airflow volume of between 100 and 200,000 cubic feet per minute and capable of sustaining gas pressures of between 0.1 and 30 inches of water column. The vertical pervious aerator tube 107 is in direct communication 106 with a ambient or heated air moving means 105, wherein the air discharged by the vertical pervious aerator tube flows primarily horizontally 119, except near the top biological product surface where the airflow may become primarily perpendicular to the top biological product surface 104, and where the airflow moves radially through the granular biological product at a flow rate high enough to cause the granular biological product to be dried or cooled by the air flow, with the air flow passing from the granular biological product directly through pervious inner walls into one or more short cylindrical 108, full height cylindrical 120, formed V shaped 121, or half-round 122 air plenum chambers spaced close to the outer impervious structural wall of the storage structure. The air in receiving plenum chambers 108 provide one or more receiving volumes at low pressure, void of stored product, which the air or gas will naturally flow into, and with the plenum chambers also functioning to guide the exhausting air 109 to an exit opening 110 in the sidewall, the base or roof structure, the sidewall, base and roof, or the sidewall and roof exits of the storage structure.

The storage container in the grain storage aeration and drying system is comprised of a mostly sealed storage bin 100 wherein the air moving means 129 is arranged to provide air or gas directly 112 from the headspace of the mostly sealed storage bin to the aeration duct at the base of the storage to provide a continuous closed recirculation 112 of air or gas in the grain mass and headspace to maintain uniform grain temperatures throughout the granular biological product bed 120, and at the same time maintaining the grain moisture uniformly throughout the granular biological product bed, thereby avoiding moisture loss from the product or moisture accumulation in concentrated sections of the granular biological product bed 120, such as near the top biological product surface 104 or against cold sidewalls 101, thereby avoiding mold development in the granular biological product bed, such that grain quality and grain moisture, and thus market weight is maintained at a very high level using a fan 105 sized to provide one complete air or gas exchange within 4 to 48 hours.

Another embodiment of the grain storage aeration and drying system is comprised of a in-bin cross-flow drying system that can be operated while the storage holding capacity is being filled, such as between 25-30% of capacity, wherein the aeration drying fans can be operated by moving air substantially through the newly stored grain in the lower portion of the storage, with the airflow exhaust from the grain moving through the inner pervious structural wall of the storage structure into the air receiving plenum chambers 108 wherein sidewall vents 110 in the lower portion of the outer impervious structural wall of the storage structure, directly adjacent to the freshly stored moist grain 120, are partially or fully open, wherein all other exhaust vents 110, 111 are maintained in closed position such that the storage volume in the non-filled sections of the storage volume are substantially sealed, thus allowing drying of the grain in the lower volume of the partially filled bin, before the bin can be completely filled, when adverse weather may prohibit further harvest needed for filling the complete bin for several days, thus protecting the early harvested grain from spoilage.

In another embodiment the storage container 100 is comprised of a continuous flow tower dryer or a continuous recirculation batch tower dryer, with a vertical pervious aerator tube 107 with one or more separate compartments such that, high airflows of substantially warmed air can be supplied to the top ¼ portion of the moist grain volume relative to the bottom of the grain volume for fast removal of free surface moisture, and wherein airflow in the 2nd grain volume, from ½ to ¾ of the grain volume, relative to the bottom of the grain volume is supplied with a substantial air volume, but with slightly heated or ambient air and wherein the grain in the 3rd grain volume from ¼ to ½ of the grain volume relative to the bottom of the grain volume receives warm air at a higher volume than the previous ¼ of the 2nd grain volume above the grain in the 3rd section of the grain bed from the top, and wherein the bottom ¼ of the grain volume receives ambient air for cooling the grain for transfer to storage, or heated air to continue drying, and wherein the grain is transferred warm to a storage bin designed for aeration cooling or for Dryeration cooling, and wherein the lower part of the grain volume in the continuous flow in-bin cross-flow tower drier is comprised of adjustable grain flow control 117 which can be adjusted to provide bulk flow of the grain downward 118 through the various drying zones, and wherein the adjustable grain flow control 117 can be modulated such that a cylindrical column of grain towards the centerline of the grain volume can be caused to flow faster while the outer cylindrical grain column flows downward at a slower rate to keep the inner column of grain from over drying while the outer grain volume is retained longer in the drying zone.

In another embodiment, the cross-flow air movement 119 becomes substantially diagonal or inclined in relation to horizontal as the airflow discharges from the vertical pervious aerator tube substantially near the top biological product surface, and wherein the air from the aerator tube may flow at an angle from horizontal through the shortest air path which is essentially perpendicular to the top biological product surface 104 as it exits the top biological product surface 104 into the headspace of the storage.

In another embodiment, the vertical pervious aerator tube 107 comprises one or more independent vertical compartment sections with an impervious divider panel at the top and bottom, wherein the independent vertical compartment sections communicating independently with the primary air supply means, wherein the control of the independent vertical compartment sections allows each independent vertical compartment section to receive up to a maximum airflow or less than maximum airflow from the air supply means via the impervious divider panel at the bottom controlling the air flow to that section of the vertical aerator tube 107, wherein the air movement through the stored product mass adjacent to the controlled aerator tube section may cause it to be cooled or dried faster or slower than stored product adjacent the other aerator tube sections.

In another embodiment, the vertical pervious aerator tube 107 comprises only one vertical compartment receiving all the air supplied by the air supply source 105, wherein the sidewall air receiving plenum chambers 108 are comprised of a plurality of relatively short vertical cylindrical pervious compartments substantially attached to the impervious storage structure sidewall, with the pervious panels spaced outward between 2 to 8 inches from and parallel to the outer impervious sidewall and structurally braced from the sidewall to provide a receiving chamber for the primarily horizontal cross-flow exhausting airflow, wherein the impervious sidewall structure has an exhaust vent 110 communicating between the air receiving plenum chambers 108 and the outside ambient environment, wherein the exhaust vent comprises one or more openings and a means of control such that the air entering the appropriate level of air receiving plenum chambers can be controlled by leaving the vent valve 110 means fully open, or restricting the flow of air 109 from the plenum level such that less flow or no flow is allowed to exhaust, thus allowing a maximum cooling or drying air to exhaust, or less than a maximum of processing air to pass through the grain, allowing selective processing of grain at each of the levels of plenum chambers 108 and exhaust vents 109.

In another embodiment, the vertical pervious aerator tube 107 comprises only one compartment receiving all the air supplied by the air supply source, but wherein the sidewall plenum 121 is comprised of a porous wall spaced substantially close to and spaced essentially uniformly from the storage structure outer wall to form a continuous cylindrical air plenum chamber 121, wherein the inner pervious wall extends from near the floor of the storage, allowing pieces of grain and chaff to fall onto the grain at the bottom of the plenum chamber volume 126, to near the roof structure 125 of the storage, such that an opening along the top of the inner pervious wall allows exhaust air to flow upward into the headspace of the storage, and the inner wall 121 extends above the slope of the stored product surface 104 at its maximum fill level, and whereas the roof structure 125 contains substantial exhaust vents 111 with control means such that each vent can be fully open, or can be substantially closed to regulate the amount of exhaust gas that it passes to the point where no exhaust gas may pass through the vent, and the structural sidewall may contain one or a plurality of sidewall vents 110 whereby the sidewall vents can pass exhaust gases 109 rising upward or flowing downward to exhaust from the sidewall vent 110, and with the vent contains control means to allow passage of a maximum volume of air or gas, or can allow the passage of a portion of the exhaust air or gas volume, or no exhaust air or gas, or wherein all vents 110, 111 may be closed to provide a sealed storage environment for effective fumigation of the stored products.

In another embodiment, the vertical aerator tube comprises only one compartment receiving all the air supplied by the air supply source, but wherein the sidewall plenum is comprised of a plurality of relatively narrow long vertical pervious formed 122 or rolled elements 123 which when connected to the outer wall of the storage structure provides a plurality of vertical exhaust plenums 122, 123 which extend substantially from near the floor of the storage to substantially close to the roof structure of the storage, such that the opening at the top of the pervious formed wall plenums 109 allow exhaust air to flow upward into the headspace of the storage, with the plurality of formed plenums extend above the slope of the stored product at its maximum fill level, or whereas the vertical wall plenum sections 122, 123 are mounted to the outer wall 101 by vertical pervious structural spacer brackets wherein the multiplicity of adjacent vertical plenum sections communicate with all other vertical plenum sections around the circumference of the outer wall to form a continuous plenum chamber 126 providing communication of exhaust gases with sidewall vents spaced at desirable locations to exhaust gases laterally and vertically, as substantially as the smooth cylindrical plenum 121, and whereas the roof structure contains substantial exhaust vents 111 with control means such that each the vent can be fully open, or can be substantially closed to regulate the amount of exhaust gas 109 that it passes to the point where no exhaust gas may pass through the vent, and the vents may be closed to substantially seal the roof headspace for effective fumigant gas retention during fumigations of the stored products in the storage structure.

In another embodiment, a source of ozone gas 113 is communicated to the air supply means such that the ozone gas and air mixture is substantially communicated to the granular biological stored products for the purpose of enhancing the storability of the stored products through the fumigating characteristics of the ozone to control pests such as insects, molds, microbes, fungus, toxins, odors and other undesirable characteristics of the stored products for the purpose of enhancing storability and market quality of the stored products, and whereby the ozonated seeds are cleaned of microbes, molds and other infesting biological materials, with the further purpose of the ozone treatment to enhance the germination vigor of the seeds to increase plant emergence, growing plant vigor, productivity and product quality through enhanced seed characteristics such as stronger germ and increased protein.

In another embodiment, a source of ozone gas 113 is communicated substantially to the base of the storage structure, the under-roof headspace of the storage structure and other unsealed or poorly sealed sections of the storage structure for the purpose of producing a modified gas atmosphere which will be objectionable to stored product insects and other pests, whereby insects and pests will exit the storage structure, or will not enter the storage structure, wherein the ozone gas treatment may be released continually, or intermittently as needed for economical exclusion of stored product insects from the storage, thereby substantially providing long term storage protection of the stored products against stored product insects.

In another embodiment, the cross-flow drying system 119 has one airflow source 105 delivering airflow to a plurality of airflow tubes 106, each in communication with one of a plurality of segmented chambers spaced vertically in the tube, each chamber with an impervious panel separating it from other chambers, such that individual air sources can be operated singly or in multiples to provide partial or total drying airflow at selected levels in the stored product bed.

In another embodiment, the cross-flow drying system has one or a plurality of airflow sources 105 communicating with a central vertical aerator tube 107 with one chamber, or with a central aerator tube 107 with a plurality of segmented chambers spaced vertically in the tube, each chamber with an impervious panel separating it from other chambers, such that individual air sources can be operated singly or in multiples to provide drying airflow at selected levels in the stored product bed.

In another embodiment, a purposely small air moving device 129 is in direct communication 112 with the headspace of the stored product storage structure and the air duct from the aeration or drying airflow source, preferably, but not necessarily, connected to draw air from the headspace at the top of the structure and push that air into the primary air communication means 105 at the base of the structure (best shown in FIGS. 1 and 2), for the purpose of providing a low airflow or gas flow system in a closed recirculation system 112 which can recirculate air or gas relatively slowly at a desired exchange rate throughout a sealed storage structure for the purpose of maintaining a relatively uniform stored product temperature for substantially long periods of time to minimize possible "moisture migration" while minimizing product market moisture weight loss, whereas this recirculation system 112 may also function to recirculate a fumigant gas, such as ozone (03), phosphine (PH3) or sulfuryl fluoride (SF) during a fumigation event, thus providing a very economical long term closed aeration air and fumigant gas recirculation system within the substantially or partially sealed structure 100, with the small air moving device 112, 129 also serving as a means to aerate and flush the fumigant gas from the storage and stored product volume when the fumigation is complete to "clear" the grain of fumigant, by disconnecting the inlet tube 112 connection from the air moving device 129, thus allowing the air moving device 129 to purge the structure from the base with a continuous flow of ambient air for a desired amount of gas exchanges or until a satisfactory low or no gas reading is obtained.

In another embodiment, an aeration pressure airflow source 116 for flat floored storage structures is placed in communication with a floor ducting system 128 which pressurizes an air plenum under a pervious steel floor system 128 consisting of sloped steel formed or fastener connected panels on both sides of a porous steel panel which when pressurized by the air source airflow substantially fluidizes the granular biological products causing them to flow along the slightly sloped (from 5 to 10% slope from horizontal) porous duct 128 to the discharge conveyor receiving hopper at substantially the centerline of the storage structure, or at multiple grain receiving hoppers along the under-floor discharge conveyor, normally along the centerline of the storage structure, to cleanout the final portion of the granular product that will not gravity flow from the storage structure, for the purpose of discharging all remaining product from the structure to minimize workers from entering the structure to cleanout the residual dried or cooled product.

In another embodiment, the grain storage aeration and drying system further comprises an adjustable metering means 117 for causing the grain to flow continuously at variable speeds downward, as desired, or the grain flow may be intermittent for the purpose of moving the grain downward while airflow is mostly horizontal, so that some dried grain is removed continuously or periodically as desired from the bottom or lower section of the dryer, while moist grain needing to be dried is being transferred into the top of the structure.

In another embodiment, the bin dryer has an air source 105 with a burner air heating source 114, which is operated by a control means such that the heater 114 substantially warms the ambient drying air for a selected time, such as 1.5 to 2.5 hours, then the burner heat is stopped while ambient air continues flowing through the grain for a selected time, such as 0.5 to 0.75 hours, with the dryer control means continuing to alternate the heated and non-heated airflow at the specified time settings for multiple cycles, for the purpose of alternating heating, then tempering the moist grain, wherein this preferred method of drying is found to increase the rate of drying and thus reducing the drying time by a substantial amount, such as 15-25%, compared with continuous heating of the air with no alternating ambient tempering airflow.

In another embodiment, the dryer is configured substantially the same as the continuous-flow process, with metering floor means providing uniform or non-uniform vertical flow, but with the unload conveying means 115 substantially arranged such that the product being discharged from the dryer is returned by fill conveyor 127 to the dryer top fill point 102 and is recycled by the fill conveyor 127 multiple times as a recirculation batch drying process for enhancement of drying of heat sensitive biological products like rice (paddy), or for the purpose of thoroughly mixing and blending the grain for uniform exposure of continuous ozone treatment 113 of seed grains, providing a pre-plant seed treatment process that has been found to be substantially beneficial with increased emergence by as much as 20 to 40% and producing increased plant vigor and productivity with enhanced seed characteristics, such as increased protein content of soybeans, wheat and corn, compared with non-ozone treated seeds.

In another embodiment, the central perforated aerator tube 107 has several compartments which may be supplied with air of various volumes and air of various temperatures, for the purpose of supplying different volumes and temperatures of air for the purpose of applying more or less drying energy to the downward flowing 118 or intermittently flowing grain 118 such that grain moisture is removed at a desired rate, so the grain quality is maintained at a high level.

REFERENCES

ASAE Standards 1993. (1993). Table 1. Equilibrium moisture content of grains and seeds (percent wet basis), ASAE D245, DEC92, Moisture Relationships of Grain, American Society of Agricultural and Biological Engineers, St. Joseph, Mich., USA, 413-414.

Day, D. L. and Nelson, G. L. (1962). Predicting performances of cross-flow systems for drying grain in storage in deep cylindrical bins. ASAE Paper No. 62-925, American Society of Agricultural Engineers, St. Joseph, Mich., USA, December.

Day, D. L. and Nelson, G. L. (1964). Drying effects of cross-flow air circulation on wheat stored in deep cylindrical bins. Technical Bulletin No. T-106, Oklahoma Agricultural Experiment Station, Oklahoma State University, Stillwater, Okla., January.

Jayas, D. S. and Mann, D. (1994). Presentation of airflow resistance data of seed bulks, Applied Engineering in Agriculture, American Society of Agricultural Engineers, St. Joseph, Mich., USA, 10(1), 79-83.

Jayas, D. S. and Muir, W. E. (1991). Airflow-pressure drop data for modeling fluid flow in anisotropic bulks, Transactions of ASAE, American Society of Agricultural Engineers, 34(1), 251-254.

Navarro, S., Noyes, R. and Armitage, D. (2002). Supplemental aeration systems, Chapter 8, The Mechanics and Physics of Modem Grain Aeration Management, Navarro and Noyes, Editors, CRC Press, Boca Raton, Fla., 417-424.

TABLE 1

Comparison of Five Vertical to Horizontal Airflows* Using Vertical Bin Fan Power Settings in an 8 m Dia × 20 m Sidewall Height, 800 Ton Bin

| | Vertical Airflow | | | Horizontal Airflow | | | |
|---|---|---|---|---|---|---|---|
| Grain Type | Airflow Rate $m^3/m/m^3$ | Static Press $g/cm^2$ | KW | Airflow Rate $m^3/m/m^3$ | Static Press $g/cm^2$ | KW | H/V Ratio. |
| Maize | 0.08 | 9 | 3.6 | 0.42 | 1.6 | 3.6 | 5.2 |
| | 0.16 | 20 | 16.1 | 1.16 | 2.7 | 16.1 | 7.2 |
| | 0.24 | 34 | 41.4 | 1.93 | 4.2 | 41.4 | 8.0 |
| | 0.32 | 52 | 82.8 | 2.70 | 6.0 | 82.8 | 8.4 |
| | 0.40 | 71 | 143.0 | 3.46 | 8.2 | 143.0 | 8.6 |
| Wheat | 0.08 | 25 | 10.3 | 0.60 | 3.3 | 10.3 | 7.5 |
| | 0.16 | 54 | 43.8 | 1.34 | 6.4 | 43.8 | 8.4 |
| | 0.24 | 87 | 105.9 | 2.09 | 10.0 | 105.9 | 8.7 |
| | 0.32 | 124 | 201.4 | 2.82 | 14.0 | 201.4 | 8.8 |
| | 0.40 | 165 | 334.6 | 3.57 | 18.5 | 334.6 | 8.9 |
| Sunflower (oil) | 0.08 | 12 | 5.0 | 0.50 | 2.0 | 5.0 | 6.2 |
| | 0.16 | 28 | 22.5 | 1.24 | 3.6 | 22.5 | 7.8 |
| | 0.24 | 47 | 57.2 | 2.02 | 5.7 | 57.2 | 8.4 |
| | 0.32 | 70 | 113.4 | 2.76 | 8.1 | 113.4 | 8.6 |
| | 0.40 | 96 | 194.9 | 3.51 | 11.0 | 194.9 | 8.8 |
| Soybean | 0.08 | 7.5 | 3.0 | 0.37 | 1.6 | 3.0 | 4.6 |
| | 0.16 | 16 | 12.6 | 1.07 | 2.3 | 12.6 | 6.7 |
| | 0.24 | 26 | 30.9 | 1.83 | 3.3 | 30.9 | 7.6 |
| | 0.32 | 37 | 59.7 | 2.60 | 4.6 | 59.7 | 8.1 |
| | 0.40 | 50 | 100.7 | 3.36 | 5.9 | 100.7 | 8.4 |
| Sorghum | 0.08 | 25 | 10.1 | 0.60 | 3.3 | 10.1 | 7.5 |
| | 0.16 | 53 | 42.8 | 1.33 | 6.3 | 42.8 | 8.3 |
| | 0.24 | 84 | 102.8 | 2.08 | 9.8 | 102.8 | 8.7 |
| | 0.32 | 120 | 194.6 | 2.82 | 13.6 | 194.6 | 8.8 |
| | 0.40 | 159 | 322.0 | 3.56 | 17.8 | 322.0 | 8.9 |

*NOTE: Data developed using FANS computer program, developed by Dr. W. Wilcke, Univ. of Minnesota; Dr. D. Maier, Purdue Univ. H/V Ratio compares horizontal to vertical airflow.

TABLE 2

Comparison of Vertical to Horizontal Airflows* Using Vertical Airflow Fan Power Settings For a Range of Bin Sizes

| Bin Size | Vertical Airflow | | | Horizontal Airflow | | | |
|---|---|---|---|---|---|---|---|
| (dia × ht, meters) Grain | Airflow Rate $m^3/m/m^3$ | Static Press $g/cm^2$ | KW | Airflow Rate $m^3/m/m^3$ | Static Press $g/cm^2$ | KW | H/V Ratio. |
| | | | Maize | | | | |
| 10 × 15 | 0.08 | 5.2 | 2.4 | 0.25 | 1.6 | 2.4 | 3.1 |
| 10 × 20 | 0.08 | 8.8 | 5.6 | 0.38 | 1.8 | 5.6 | 4.8 |
| 15 × 20 | 0.08 | 8.8 | 12.6 | 0.30 | 2.4 | 12.6 | 3.8 |

TABLE 2-continued

Comparison of Vertical to Horizontal Airflows* Using Vertical Airflow Fan Power Settings For a Range of Bin Sizes

| Bin Size | Vertical Airflow | | | Horizontal Airflow | | | |
|---|---|---|---|---|---|---|---|
| (dia × ht, meters) Grain | Airflow Rate $m^3/m/m^3$ | Static Press $g/cm^2$ | KW | Airflow Rate $m^3/m/m^3$ | Static Press $g/cm^2$ | KW | H/V Ratio. |
| 15 × 25 | 0.08 | 13.6 | 24.1 | 0.38 | 2.8 | 24.1 | 4.8 |
| 20 × 25 | 0.08 | 13.6 | 42.9 | 0.31 | 3.5 | 42.9 | 3.9 |
| 20 × 30 | 0.08 | 20.3 | 77.1 | 0.38 | 4.2 | 77.1 | 4.8 |
| | | | Wheat | | | | |
| 10 × 15 | 0.08 | 14.2 | 6.7 | 0.35 | 3.1 | 6.7 | 4.4 |
| 10 × 20 | 0.08 | 25.4 | 16.1 | 0.50 | 4.0 | 16.1 | 6.2 |
| 15 × 20 | 0.08 | 25.4 | 36.1 | 0.34 | 6.0 | 36.1 | 4.2 |
| 15 × 25 | 0.08 | 39.4 | 69.7 | 0.42 | 7.4 | 69.7 | 5.2 |
| 20 × 25 | 0.08 | 39.4 | 123.9 | 0.34 | 9.1 | 123.9 | 4.2 |
| 20 × 30 | 0.08 | 58.1 | 221.0 | 0.42 | 10.9 | 221.0 | 5.2 |
| | | | Sunflowers (oil) | | | | |
| 10 × 15 | 0.08 | 5.2 | 2.4 | 0.26 | 1.6 | 2.4 | 3.2 |
| 10 × 20 | 0.08 | 8.8 | 5.6 | 0.38 | 1.8 | 5.6 | 4.8 |
| 15 × 20 | 0.08 | 8.8 | 12.6 | 0.29 | 2.5 | 12.6 | 3.6 |
| 15 × 25 | 0.08 | 13.6 | 24.1 | 0.37 | 2.9 | 24.1 | 4.6 |
| 20 × 25 | 0.08 | 13.6 | 42.9 | 0.31 | 3.5 | 42.9 | 3.9 |
| 20 × 30 | 0.08 | 20.3 | 77.2 | 0.38 | 4.2 | 77.2 | 4.8 |
| | | | Soybeans | | | | |
| 10 × 15 | 0.08 | 4.5 | 2.1 | 0.18 | 1.9 | 2.1 | 2.2 |
| 10 × 20 | 0.08 | 7.5 | 4.7 | 0.26 | 2.2 | 4.7 | 3.2 |
| 15 × 20 | 0.08 | 7.5 | 10.6 | 0.19 | 3.2 | 10.6 | 2.4 |
| 15 × 25 | 0.08 | 11.2 | 19.8 | 0.24 | 3.8 | 19.8 | 3.0 |
| 20 × 25 | 0.08 | 11.2 | 35.3 | 0.20 | 4.5 | 35.3 | 2.5 |
| 20 × 30 | 0.08 | 16.3 | 62.1 | 0.24 | 5.3 | 62.1 | 3.0 |
| | | | Sorghum | | | | |
| 10 × 15 | 0.08 | 13.9 | 6.6 | 0.23 | 4.7 | 6.6 | 2.9 |
| 10 × 20 | 0.08 | 24.9 | 15.8 | 0.32 | 6.1 | 15.8 | 4.0 |
| 15 × 20 | 0.08 | 24.9 | 35.5 | 0.21 | 9.5 | 35.5 | 2.6 |
| 15 × 25 | 0.08 | 38.6 | 68.2 | 0.26 | 11.8 | 68.2 | 3.2 |
| 20 × 25 | 0.08 | 38.6 | 121.3 | 0.21 | 14.1 | 121.3 | 2.6 |
| 20 × 30 | 0.08 | 56.8 | 216.0 | 0.26 | 17.5 | 216.0 | 3.2 |

*NOTE: Data developed using FANS computer program, developed by Dr. W. Wilcke, Univ. of Minnesota; Dr. D. Maier, Purdue Univ. H/V Ratio compares horizontal to vertical airflow.

What is claimed is:

1. A grain storage aeration and drying system comprising a storage container comprising an impervious base or bottom structure, an impervious sidewall structure, and a partially sealed roof structure;

wherein the storage container holds granular biological product;

wherein the granular biological product forms a top surface of the granular biological product;

an air moving means to force air, or a mixture of air and another gas or gases, in a mostly horizontal or cross-flow process through the granular biological product held in the storage container for purposes of conditioning, improving storage and maintaining the granular biological product;

a vertical pervious aerator tube comprised of an upper end and a lower end and placed essentially in the center of the storage container with the vertical pervious aerator tube surrounded by the granular biological product with the vertical pervious aerator tube extending to substantially beneath the top surface of the granular biological product when the granular biological product is at maximum depth;

wherein the air moving means comprises one or more fans or blowers capable of delivering an airflow volume of between 100 and 200,000 cubic feet per minute and capable of sustaining gas pressures of between 0.1 and 30 inches water column;

wherein the vertical pervious aerator tube is in direct communication with a ambient or heated air moving means;

wherein the air discharged by the vertical pervious aerator tube flows primarily horizontally, except near the top biological product surface where the airflow may become primarily perpendicular to the top surface of the granular biological product, and where the airflow moves radially through the granular biological product at a substantial rate, causing the granular biological product to be dried or cooled by the air flow, with the air flow passing from the granular biological product directly through pervious inner walls into one or more air receiving plenum chambers spaced close to the outer impervious structural wall of the storage structure; and wherein the air receiving plenum chambers provide one or more volumes at low pressure, void of granular biological product, which the air or gas will naturally flow into, and with the plenum chambers also functioning to guide the exhausting air to an exit opening in the sidewall, the base or roof structure, the sidewall, base and roof, or the sidewall and roof exits of the storage structure.

2. The grain storage aeration and drying system as described in claim 1, wherein the storage container is a mostly sealed storage bin; and wherein the one or more fans or blowers are arranged to provide air or gas directly to the headspace of the mostly sealed storage bin to provide a continuous closed recirculation of air or gas in the granular biological product and headspace to maintain uniform grain temperatures throughout the granular biological product, and at the same time maintaining the grain moisture uniformly throughout the granular biological product, thereby avoiding moisture loss from the granular biological product or moisture accumulation in concentrated sections of the granular biological product, such as near the top surface of the granular biological product or against cold sidewalls, thereby avoiding mold development in the granular biological product bed using a fan sized to provide one complete air or gas exchange within 4 to 48 hours.

3. The grain storage aeration and drying system as described in claim 2, wherein a low volume air moving means is in direct communication with the headspace of the stored product storage structure and the air duct from the air moving means connected to draw air from the headspace at the top of the structure and pushes that air into the primary air communication means at the base of the structure for the purpose of providing a low airflow or gas flow system in a closed recirculation system which can recirculate air or gas relatively slowly at a desired exchange rate throughout the sealed storage structure for the purpose of maintaining a relatively uniform stored product temperature for substantially long periods of time to minimize possible moisture migration while minimizing product market moisture weight loss;

wherein this recirculation functions to recirculate a fumigant gas within the substantially or partially sealed structure;

wherein the fumigant gas is ozone, phosphine, or sulfuryl fluoride; and wherein the small air moving means also serves as a means to aerate and flush the fumigant gas from the storage and stored product volume when the fumigation is complete.

4. The grain storage aeration and drying system as described in claim 1, wherein the in-bin cross-flow drying system can be operated while the storage container is between 25-30% of capacity;

wherein the aeration drying fans can be operated by moving air substantially through the granular biological product in the lower portion of the storage container, with the airflow exhaust from the granular biological product moving through the inner pervious structural wall of the storage container into the air receiving plenum chambers;

wherein sidewall vents in the lower portion of the outer impervious structural wall of the storage container, directly adjacent the freshly stored moist grain, are partially or fully open; and wherein all other exhaust vents are maintained in closed position such that the storage volume in the non-filled sections of the storage container are substantially sealed, thus allowing drying of the granular biological product in the lower volume of the partially filled storage container before the storage container can be completely filled.

5. The grain storage aeration and drying system as described in claim 1, wherein the storage container is comprised of a continuous flow tower dryer or a continuous recirculation batch tower dryer, with a vertical pervious aerator tube with one or more separate compartments such that, high airflows of substantially warmed air can be supplied to the top ¼ portion of the moist granular biological product relative to the bottom of storage container for fast removal of free surface moisture;

wherein airflow in the $2^{nd}$ granular biological product volume, from ½ to ¾ of the granular biological product, relative to the bottom of the storage container is supplied with a substantial air volume, but with slightly heated or ambient air;

wherein the granular biological product in the $3^{rd}$ granular biological product volume from ¼ to ½ of the grain volume relative to the bottom of the storage container receives warm air at a higher volume than the previous ¼ of granular biological product volume above the grain in the $3^{rd}$ section of the granular biological product bed from the top;

wherein the bottom ¼ of the granular biological product volume receives ambient air for cooling the granular biological product for transfer to storage, or heated air to continue drying;

wherein the granular biological product is transferred warm to a storage bin designed for aeration cooling or for Dryeration cooling;

wherein the lower part of the granular biological product volume in the continuous flow in-bin cross-flow tower drier is comprised of adjustable grain flow control which can be adjusted to provide bulk flow of the grain downward through the various drying zones; and wherein the adjustable grain flow control can be modulated such that a cylindrical column of granular biological product towards the centerline of the granular biological product volume can be caused to flow faster while the outer cylindrical granular biological product column flows downward at a slower rate to keep the inner column of granular biological product from over drying while the outer granular biological product volume is retained longer in the drying zone.

6. The grain storage aeration and drying system as described in claim 5, wherein a means for causing the grain to flow continuously at variable speeds or intermittently downward for the purpose of moving the grain downward while airflow is mostly horizontal, so that some dried grain is removed continuously or periodically as desired from the bottom or lower section of the dryer, while moist grain needing to be dried is being transferred into the top of the structure.

7. The grain storage aeration and drying system as described in claim 5 further comprising a metering floor means providing vertical flow, but with the unload conveying means substantially arranged such that the product that is discharged from the dryer is returned to the dryer top fill point and is recycled multiple times as a recirculation batch drying process for enhancement of drying of heat sensitive biological products or for the purpose of thoroughly mixing and blending the grain for uniform exposure of continuous ozone treatment of seed grains, providing a pre-plant seed treatment process which enhances germination, emergence and productivity, and product quality compared with conventionally treated or non-treated seeds.

8. The grain storage aeration and drying system as described in claim 1, wherein the cross-flow air movement becomes substantially diagonal or inclined in relation to horizontal as the airflow discharges from the vertical pervious aerator tube substantially near the top surface of the granular biological product; and wherein the air from the aerator tube may flow at an angle from horizontal through the shortest air path which is essentially perpendicular to the top granular biological product surface as it exits the top surface of the granular biological product into the headspace of the storage.

9. The grain storage aeration and drying system as described in claim 1, wherein the vertical pervious aerator tube further comprises one or more independent vertical compartment sections with an impervious divider panel at the top and bottom;

wherein the independent vertical compartment sections communicating independently with the primary air supply means;

wherein the control of the independent vertical compartment sections allows each independent vertical compartment section to receive up to a maximum airflow or less than maximum airflow from the air supply means via the impervious divider panel at the bottom controlling the air flow to that section of the vertical aerator; and wherein the air movement through the granular biological product adjacent to the controlled aerator tube section may be cooled or dried faster or slower than granular biological product adjacent the other aerator tube sections.

10. The grain storage aeration and drying system as described in claim 1, wherein the vertical pervious aerator tube comprises only one vertical compartment receiving all the air supplied by the air supply source;

wherein the sidewall air receiving plenum chambers are comprised of a plurality of relatively short vertical cylindrical pervious compartments substantially attached to the impervious storage structure sidewall, with the pervious panels spaced outward between 2 to 8 inches from and parallel to the outer impervious sidewall and structurally braced from the sidewall to provide a receiving chamber for the primarily horizontal cross-flow exhausting airflow;

wherein the impervious sidewall structure has an exhaust vent communicating between the air receiving plenum chambers and the outside ambient environment; and wherein the exhaust vent comprise one or more openings and a means of control such that the air entering the appropriate level of air receiving plenum chambers can be controlled by leaving the vent valve means fully open, or restricting the flow of air from the plenum level such that less flow or no flow is allowed to exhaust, thus allowing a maximum cooling or drying air to exhaust, or less than a maximum of processing air to pass through the granular biological product, allowing selective processing of granular biological product at each of the levels of plenum chambers and exhaust vents.

11. The grain storage aeration and drying system as described in claim 1, wherein the vertical pervious aerator tube comprises only one compartment receiving all the air supplied by the air supply source;

wherein the sidewall plenum is comprised of a porous wall spaced substantially close to and spaced essentially uniformly from the storage structure outer wall to form a continuous cylindrical air plenum chamber;

wherein the inner pervious wall extends from near the floor of the storage, allowing pieces of granular biological product and chaff to fall onto the granular biological product at the bottom of the plenum chamber, to near the roof structure of the storage, such that an opening along the top of the inner pervious wall allows exhaust air to flow upward into the headspace of the storage, and the inner wall extends above the slope of the stored product at its maximum fill level; and wherein the roof structure contains substantial exhaust vents with control means such that each vent can be fully open, or can be substantially closed to regulate the amount of exhaust gas that it passes to the point where no exhaust gas may pass through the vent, and the structural sidewall may contain one or a plurality of sidewall vents whereby the sidewall vents can pass exhaust gases rising upward or flowing downward to exhaust from the sidewall vent, and with the vent contains control means to allow passage of a maximum volume of air or gas, or can allow the passage of a portion of the exhaust air or gas volume, or no exhaust air or gas, or wherein all vents may be closed to provide a sealed storage environment for effective fumigation of the stored products.

12. The grain storage aeration and drying system as described in claim 1, wherein the vertical pervious aerator tube comprises only one compartment receiving all the air supplied by the air supply source;

wherein the sidewall plenum is comprised of a plurality of relatively narrow long vertical pervious formed or rolled elements which when connected to the outer wall of the storage structure provides a plurality of vertical exhaust plenums which extend substantially from near the floor of the storage to substantially close to the roof structure of the storage, such that the opening at the top of the pervious formed wall plenums allow exhaust air to flow upward into the headspace of the storage, with the plurality of formed plenums extending above the slope of the stored product at its maximum fill level;

wherein the vertical wall plenum sections are mounted to the outer wall by vertical pervious structural spacer brackets;

wherein the multiplicity of adjacent vertical plenum sections communicate with all other vertical plenum sections around the circumference of the outer wall to form a continuous plenum chamber providing communication of exhaust gases with sidewall vents spaced at desirable locations to exhaust gases laterally and vertically; and wherein the roof structure comprises exhaust vents with control means such that each of the vents can be fully opened or closed to regulate the amount of exhaust gas and the vents may be closed to substantially seal the roof headspace for effective fumigant gas retention during fumigations of the stored products in the storage structure.

13. The grain storage aeration and drying system as described in claim 1, wherein a source of ozone gas is communicated to the air supply means such that an ozone gas and air mixture is substantially communicated to the granular biological stored products for the purpose of enhancing the storability of the stored products through the fumigating characteristics of the ozone to control pests such as insects, molds, microbes, fungus, toxins, odors and other undesirable characteristics of the stored products for the purpose of enhancing storability and market quality of the stored products; and wherein the ozonated seeds are cleaned of microbes, molds and other infesting biological materials, with the further purpose of the ozone treatment to enhance the germination vigor of the seeds to increase plant emergence, growing plant vigor, productivity and product quality through enhanced seed characteristics such as stronger germ and increased protein.

14. The grain storage aeration and drying system as described in claim 1, wherein a source of ozone gas is communicated substantially to the base of the storage structure, the under-roof headspace of the storage structure and other unsealed or poorly sealed sections of the storage structure for the purpose of producing a modified gas atmosphere which will be objectionable to stored product insects and other pests;

wherein insects and pests will exit the storage structure, or will not enter the storage structure; and wherein the ozone gas treatment may be released continually, or intermittently as needed for economical exclusion of stored product insects from the storage, thereby substantially providing long term storage protection of the stored products against stored product insects.

15. The grain storage aeration and drying system as described in claim 1, wherein the cross-flow drying system has one airflow source delivering airflow to a plurality of airflow tubes, each in communication with one of a plurality of segmented chambers spaced vertically in the tube, each chamber with an impervious panel separating it from other chambers, such that individual air sources can be operated singly or in multiples to provide partial or total drying airflow at selected levels in the stored product bed.

16. The grain storage aeration and drying system as described in claim 1, wherein the cross-flow drying system has one or more airflow sources communicating with a central vertical aerator tube with one chamber or with a central aerator tube with a plurality of segmented chambers spaced vertically in the tube, each chamber with an impervious panel separating it from other chambers such that individual air sources can be operated singly or in multiples to provide drying airflow at selected levels in the stored product bed.

17. The grain storage aeration and drying system as described in claim 16, wherein the central vertical aerator tube has several compartments which may be supplied with air of various volumes and air of various temperatures for the purpose of applying various levels of drying energy to the downward flowing or intermittently flowing grain such that grain moisture is removed at a desired rate, so the grain quality is maintained at a high level.

18. The grain storage aeration and drying system as described in claim 1, wherein the air moving means for flat floored storage structures is placed in communication with a floor ducting system which pressurizes an air plenum under a pervious steel floor system consisting of sloped steel formed or fastener connected panels on both sides of a porous steel panel which when pressurized by the air moving means substantially fluidizes the granular biological products causing them to flow along the slightly sloped porous duct to the discharge conveyor receiving hopper at the centerline of the storage structure, or at multiple grain receiving hoppers along the under-floor discharge conveyor, normally along the centerline of the storage structure, to cleanout the final portion of the granular product that will not gravity flow from the storage structure, for the purpose of discharging all remaining product from the structure.

19. The grain storage aeration and drying system as described in claim 1, wherein the bin dryer is comprised of an air moving means with a burner air heating source, which is operated by a control means such that the heater substantially warms the ambient drying air between for a selected time, such as 1.5 to 2.5 hours, after which then the burner is stopped while ambient air continues flowing through the grain for a selected time, such as 0.5 to 0.75 hours, with the dryer control means continuing to alternate the heated and non-heated airflow at the specified time settings for multiple cycles, for the purpose of alternating heating, then tempering the moist grain, wherein this preferred method of drying is found to increase the rate of drying and thus reducing the drying time by a substantial amount, compared with continuous heating of the air with no alternating ambient tempering airflow.

* * * * *